US009826792B2

(12) United States Patent
Dowd et al.

(10) Patent No.: US 9,826,792 B2
(45) Date of Patent: Nov. 28, 2017

(54) HEADWEAR SUPPORT DEVICE

(71) Applicant: Creative Engineering, LLC, Bronxville, NY (US)

(72) Inventors: Paul Dowd, Scarsdale, NY (US); Philippe M. Putzeys, Los Angeles, CA (US)

(73) Assignee: Creative Engineering, LLC, Bronxville, NY (US)

( * ) Notice: Subject to any disclaimer, the term of this patent is extended or adjusted under 35 U.S.C. 154(b) by 0 days.

(21) Appl. No.: 14/916,217

(22) PCT Filed: Oct. 28, 2014

(86) PCT No.: PCT/US2014/062692

§ 371 (c)(1),
(2) Date: Mar. 3, 2016

(87) PCT Pub. No.: WO2015/108600

PCT Pub. Date: Jul. 23, 2015

(65) Prior Publication Data

US 2016/0295948 A1 Oct. 13, 2016

Related U.S. Application Data

(60) Provisional application No. 61/896,192, filed on Oct. 28, 2013.

(51) Int. Cl.

| | |
|---|---|
| ***A43B 3/04*** | (2006.01) |
| ***A42B 3/04*** | (2006.01) |
| ***A42B 3/18*** | (2006.01) |

(52) U.S. Cl.
CPC ..... *A42B 3/0473* (2013.01); *A42B 3/185* (2013.01)

(58) Field of Classification Search
CPC ..... A42B 3/0473; A42B 3/185
USPC ..... 2/411, 422
See application file for complete search history.

(56) References Cited

U.S. PATENT DOCUMENTS 3,103,327 A * 9/1963 Parry ..... B64C 27/20 244/17.19
3,112,801 A * 12/1963 Wallace ..... E21B 4/00 175/107
3,873,996 A * 4/1975 Varteressian ..... A42B 3/0473 2/421

(Continued)

FOREIGN PATENT DOCUMENTS

WO 2015/108600 A2 7/2015

OTHER PUBLICATIONS

International Searching Authority, PCT/US12/62692, Search Report and Written Opinion, Jul. 9, 2015, 19 pages.

(Continued)

*Primary Examiner* — Shaun R Hurley
*Assistant Examiner* — Bao-Thieu L Nguyen
(74) *Attorney, Agent, or Firm* — Dorf & Nelson LLP; Scott D. Locke, Esq.

(57) ABSTRACT

Devices that facilitate offsetting of weight of heard borne equipment such as helmets and other devices associated with helmets are provided. Through the use of pivots and an arm assembly that distributes weight from a person's head to his or her torso, additional and heavier objects can be carried on a person's head without causing undesirable levels of discomfort.

19 Claims, 28 Drawing Sheets

(56) References Cited

U.S. PATENT DOCUMENTS 4,219,193 A * 8/1980 Newman ..... A61F 5/055 128/DIG. 23
4,616,885 A 10/1986 Komiya
4,692,039 A 9/1987 Teramachi
4,782,602 A 11/1988 Lakic
4,825,476 A 5/1989 Andrews
4,954,815 A 9/1990 Delmonte
5,123,408 A * 6/1992 Gaines ..... A42B 3/0473 2/425
5,261,125 A * 11/1993 Cartwright ..... A42B 3/0473 2/421
5,267,708 A * 12/1993 Monson ..... A42B 3/0473 244/121
5,272,422 A 12/1993 Beaussant
5,295,271 A 3/1994 Butterfiled et al.
5,353,437 A 10/1994 Field et al.
5,371,905 A * 12/1994 Keim ..... A42B 3/0473 2/413
5,444,870 A 8/1995 Pinsen
5,566,399 A * 10/1996 Cartwright ..... A42B 3/0473 2/421
5,581,816 A * 12/1996 Davis ..... A42B 3/0473 2/410
5,581,820 A * 12/1996 Cartwright ..... A42B 3/0473 2/421
5,715,541 A * 2/1998 Landau ..... A41D 13/05 2/410
6,006,368 A * 12/1999 Phillips ..... A42B 3/0473 2/421
6,009,566 A * 1/2000 Hubbard ..... A41D 13/0512 2/421
6,052,835 A 4/2000 O'Shea
6,381,758 B1 5/2002 Roberts et al.
6,434,756 B1 8/2002 Hoop
6,591,430 B1 7/2003 Sledge
6,751,809 B1 * 6/2004 Cooper ..... A42B 3/0473 2/421
6,971,123 B2 * 12/2005 Weaver ..... A42B 3/0473 2/411
6,976,288 B1 12/2005 Luca
7,155,747 B2 * 1/2007 Baker ..... A42B 3/0473 2/421
7,430,767 B2 * 10/2008 Nagely ..... A42B 3/0473 2/425
7,941,873 B2 * 5/2011 Nagely ..... A42B 3/0473 2/425
8,321,965 B2 * 12/2012 Newman ..... A42B 3/0473 2/410
8,341,770 B2 * 1/2013 Siegler ..... A42B 3/0473 2/410
8,561,217 B2 * 10/2013 Nagely ..... A42B 3/0473 2/425
8,701,219 B2 * 4/2014 Duhame ..... A41D 13/015 2/455
8,834,394 B2 * 9/2014 Ghajar ..... A61F 5/055 128/846
8,850,625 B2 10/2014 Stiles
8,961,440 B2 * 2/2015 Huang ..... A61B 5/4064 600/587
9,226,707 B2 * 1/2016 Huang ..... A42B 3/0473
9,574,842 B2 * 2/2017 Tulpa ..... F41B 5/1449
2003/0057761 A1 3/2003 Shah
2004/0068779 A1 * 4/2004 Duffy ..... A42B 3/0473 2/422
2004/0194194 A1 * 10/2004 McNeil ..... A42B 3/0473 2/421
2004/0255368 A1 * 12/2004 Baker ..... A42B 3/0473 2/410
2007/0245464 A1 * 10/2007 Baker ..... A42B 3/0473 2/411
2008/0209617 A1 * 9/2008 Castillo ..... A42B 3/0473 2/461
2009/0229041 A1 * 9/2009 Tufenkjian ..... A42B 3/145 2/414
2011/0185481 A1 * 8/2011 Nagely ..... A42B 3/0473 2/422
2012/0057360 A1 3/2012 Swan
2013/0205480 A1 * 8/2013 Nagely ..... A63B 71/1291 2/425
2014/0081180 A1 * 3/2014 Ghajar ..... A61F 5/055 600/595
2014/0283287 A1 * 9/2014 Pocatko ..... A42B 3/0473 2/421
2015/0157080 A1 * 6/2015 Camarillo ..... A42B 3/0473 2/459
2016/0157543 A1 * 6/2016 Huang ..... A42B 3/0473 2/411

OTHER PUBLICATIONS

Take A Load Off—Helmet Relief Technology. Science DoD Live. Aug. 16, 2013 (Aug. 16, 2013) [online], [retrieved on Jun. 8, 2015 (Jun. 8, 2015)]. Retrieved from the internet: <URL: https://web.archive. org/web/20130827032827/http://science.dodlive. mil/2013/08/16/take-a-loadoff-helmet-relief-technology/> entire document.

Harnessing New Ideas. by HQAMC. Sep. 17, 2013 (Sep. 17, 2013) [Online], [retrieved on Jun. 9, 2015]. Retrieved from the internet: <URL: https://www.youtube.com/watch?t-1488N=OzfinY5t4ko>, entire document, especially Video at 00:04-00:08; 00:10; 00:12-00:17; 00:26-00:33; 01:13; 02:43-02:45.

* cited by examiner

HEADWEAR SUPPORT DEVICE

RELATED APPLICATION

The present application is a national stage application of PCT/US2014/062692, filed Oct. 28, 2014, which claims the benefit of the filing date of U.S. provisional patent application Ser. No. 61/896,192, filed Oct. 28, 2013, the entire disclosures of which are by reference.

GOVERNMENT RIGHTS

This invention was made with government support under W911QX-12-P-0025, which was awarded by the U.S. Army ACC-APG and W911QX-10-P-0350, which was awarded by the U.S. Army Research Development and Engineering Command (REDCOM), both on behalf the Army Research Laboratory. The U.S. government may have certain rights in this invention.

FIELD OF THE INVENTION

This invention is related generally to head mounted devices and more particularly to ones that prevent and reduce neck fatigue, strain, and injuries.

BACKGROUND OF THE INVENTION

Helmets are necessary in many circumstances, including but not limited to when work is performed by men and women of the military. In military applications, helmets have long been used to protect a user's head, and ideally the greatest percentage of the surface area of a user's head would be protected with the most effective protection available. However, protecting against particularly difficult threats requires a helmet to be made in such a way that it weighs more for each square inch of coverage that it provides, and protecting a greater percentage of the user's head requires more square inches of helmet. Both of these strategies for increased protection lead to an increase in the overall weight of the helmet. In addition, there have been increased demands for military personnel to carry devices that are designed to be mounted to their helmets, e.g., devices that impart enhanced vision capabilities. Satisfying this demand has created two sources of neck fatigue and strain: (1) discomfort due to off-center loads that tilt the helmet off its axis; and (2) discomfort due to overall headgear weight.

In order to address off-center loads, various counterbalance options have surfaced. For example, many solutions use battery packs, ammunition magazines, or communication equipment on the back of the helmet to counterbalance devices mounted to the front of the helmet. Unfortunately, these solutions add a significant amount of weight to the helmet beyond the primary device (e.g., night vision goggles), as well as stress to the neck in order to counteract the weight of the primary device and to recreate the original center of mass. Furthermore, they often render the helmet uncomfortable to wear. Thus, by addressing the first problem, these devices exacerbate the second problem.

Alternatively, some soldiers choose to cope with off-balanced helmets by adjusting the helmets with their hands as needed. Although this solution can address the issue of the helmet being off balance, it restricts the ability of soldiers to use their hands and thus can prevent them from being combat ready.

Additionally, helmets themselves, regardless of whether they are used by military personnel or are associated with devices, can, because of their weight, add a great deal of stress to the neck, and contribute to long term medical problems for users. Work has been done in the past to develop devices intended to reduce the strain on the neck from head borne weight and shock. See e.g., U.S. Pat. Nos. 4,825,476; 4,954,815; 5,267,708; 5,272,422; 5,295,271; 5,353,437; 5,444,870; 5,581,816; 6,006,368; 6,434,756; and 6,591,430. Unfortunately, these known technologies have only provided to a limited degree, satisfactory solutions, each having shortcomings in one or more of the areas of comfort, range of motion, weight tolerance and/or practicality.

Therefore, there is a need to provide devices that address the aforementioned problems with head borne equipment. The present invention is directed to this need.

SUMMARY OF THE INVENTION

In accordance with various embodiments of the present invention, the weight of head borne equipment and/or a helmet itself is offset onto the shoulders and/or other parts of a user's body, (e.g., torso) bypassing or mitigating the weight and strain on a user's neck. Through the use of the present invention, one is able to transfer the load and relieve stress on one's neck, which may have both short term and long term benefits.

According a first embodiment, the present invention provides a device for offsetting weight of head borne equipment comprising: (a) a helmet, wherein the helmet comprises a helmet pivot mount; (b) a set of shoulder connections, wherein the set of shoulder connections comprises a left shoulder pivot mount and a right shoulder pivot mount; and (c) an arm assembly, wherein the arm assembly comprises (i) an upper member, wherein the upper member is associated with the helmet at the helmet pivot mount, (ii) a left lower arm, wherein the left lower arm has an upper end and a lower end and the left lower arm is associated with the upper member at the upper end of the left lower arm, (iii) a right lower arm, wherein the right lower arm has an upper end and a lower end and the right lower arm is associated with the upper member at the upper end of the right lower arm, (iv) a left shoulder connector, wherein the left shoulder connector is associated with the lower end of the left lower arm, and associated with the left shoulder pivot mount and (v) a right shoulder connector, wherein the right shoulder connector is located at the lower end of the right lower arm and associated with the right shoulder pivot mount. As used herein, the phrase "associated with" means directly connected to another structure, or connected through one or intermediary components. Additionally, as used herein, the phrase "located at" refers to the region at which one structure is situated relative to another, and by way of example, when a shoulder connector is located at the lower end of a lower arm, the shoulder connector may be situated at or near the lowest point of the lower arm, e.g., in the terminal 20%, the terminal 10%, the terminal 5%, the terminal 2%, or the terminal 1% of the lower arm.

In this embodiment of the present invention, the arm assembly may, for example, be a contoured part that is configured to rest on the tops of a user's shoulders or to connect directly or through one or more other elements or structures to a device or structure that rest at or near the user's shoulders. Additionally, as persons of ordinary skill in the art will recognize when a set of shoulder connections is described as comprising both a left shoulder pivot mount and a right shoulder pivot mount, those two pivot mounts need not be proximate to each other and may reside in the vicinity of the user's left shoulder and right shoulder, respectively when in use.

The arm assembly of this embodiment is in the general form of an inverted Y. The upper member is a top single leg of the inverted Y and may e.g., be rigid and articulated with respect to the helmet with a one degree of freedom vertical axis pin joint, or a joint that provides a plurality of degrees of freedom, e.g., two or three degrees of freedom. The upper member may be straight or a regular or irregular arc shape, with the center of the arc (its "arc center" or "center of curvature") near the center of the helmet wearer's skull.

The lower two arms of the inverted Y are flexible and contain shoulder connectors that are capable of connecting to a body mounting platform, which may be in the form of a shoulder element, near the tops of the shoulders via, for example, ball joints. These ball joints may, for example, be located at or part of shoulder pivot mounts. The two flexible arms may be connected to each other where they meet at the center of the Y with a rigid joint, fixing the ends of the flexible elements relative to each other, or each may be connected to the same intra-arm assembly connector, forming a joint at the location.

In some embodiments, the joint at the intra-arm assembly connector acts as or contains a bearing follower that envelops the upper member, and moves freely along its length with a single degree of freedom. A rigid joint bearing follower that is constrained to traverse this arc may be used. As a result, when the device is in use, lifting forces act at the arc center regardless of the position of the joint bearing follower on the top single leg of the upper member. This configuration allows the helmet wearer to tilt his or her head back freely in order to look up without compromising the load offset function of the device.

Preferably, the lower arms are flexible elements and may be designed to be planar or slightly concave in their natural state. In some embodiments, when the arm assembly is connected, and the device is in use, the lower arms may curve or curve more relative to their state when no force is exerted on them. These lower arms, which may also be referred to as "flex arms," act as springs, providing an upward force and moment that offsets helmet weight.

When there is a pin joint at the arm assembly/helmet connection location, the device is minimally sensitive to the longitudinal location of the center of gravity of the helmet. Additionally, with increased stiffness of the arms, the invention can become a traction device and the user will feel a stronger pull, elongating and stretching the neck. Thus, this design allows the pull direction on the helmet to remain vertical even when the center of gravity of the helmet is not under the helmet pivot. Therefore, adding many desirable features to the helmet that will move its center of gravity will not undesirably change the weight felt by the user. By way of example and contrast, in the absence of a device such as the present invention, the pitch axis would remain free and adding night vision goggles to the front of the helmet would, due to their weight, pull the helmet down toward the user's eyes.

An additional benefit of the present invention is that it is advantageous with different sized persons. Different sized persons have different body shapes, and their different shapes in turn will change the geometry of the system when in use, e.g., how a device sits on a person's shoulder and where the person's helmet is located relative to their shoulders. However, the ability of the system to redistribute weight is not undesirably sensitive to these changes. In addition, certain variations of this embodiment include an arm roll bearing at the upper end of the upper arm, which effectively adds roll freedom of movement to the helmet connection.

According to a second embodiment, the present invention provides a device for offsetting weight of head borne equipment comprising: (a) a helmet, wherein the helmet comprises a helmet pivot mount; and (b) an arm assembly, wherein the arm assembly comprises (i) an upper member, wherein the upper member has a first end and a second end, and is associated with the helmet at the first end of the upper member, wherein the upper member comprises (1) an arm roll bearing, (2) a top bearing, (3) a top bearing holder, wherein the arm roll bearing, the top bearing and the top bearing holder are located at or near the first end, (4) an arm bearing and (5) an arm bearing travel stop; (ii) a left lower flexible arm, wherein the left lower flexible arm has an upper end and a lower end and the left lower flexible arm is associated with the upper member at the upper end of the left lower flexible arm, (iii) a left adapter, (iv) a left rod end bearing, (v) a left shoulder connector, (vi) a left shoulder base, wherein the left adapter, the left rod end bearing, the left shoulder connector and the left shoulder base are located at the lower end of the left lower flexible arm, (vii) a right lower flexible arm, wherein the right lower flexible arm has an upper end and a lower end and the right lower flexible arm is associated with the upper member at the upper end of the right lower flexible arm, (viii) a right adapter, (ix) a right rod end bearing, (x) a right shoulder connector, and (xi) a right shoulder base, wherein the right adapter, the right rod end bearing, the right shoulder connector and the right shoulder base are located at the lower end of the right lower flexible arm. The shoulder connectors permit connection to a shoulder element and enable pivot relative to a shoulder mount such as a shoulder pivot mount.

According to a third embodiment, the present invention provides a device for offsetting weight of head borne equipment comprising: (a) a helmet, wherein the helmet comprises a helmet pivot mount; (b) an arm assembly, wherein the arm assembly comprises (i) a left arm, wherein the left arm has an upper end and a lower end and the left arm is associated with the helmet at the helmet pivot mount, and (ii) a right arm, wherein the right arm has an upper end and a lower end and the right arm is associated with the helmet at the helmet pivot mount; and (c) a shoulder element, wherein the shoulder element is configured to rest on a user's shoulders and the shoulder element comprises a left pivot and a right pivot, wherein the left arm is capable of movement at the left pivot and the right arm is capable of movement at the right pivot. In one variation of this embodiment the upper ends of the left and right arms are fixed to each other to form an inverted "V" shape and a ball joint connection is provided at the apex of the V connecting it to the helmet pivot mount. This ball joint connection may, for example, be in the form of a spherical bearing providing three rotational degrees of freedom.

According to fourth embodiment, the present invention provides a device for support comprising: (a) a curved element comprising a curve having a shape, wherein the radius of curvature at each point along the curve places a center of curvature within a space that corresponds to a head of a person; and a bearing element, wherein the bearing element is free to move to different points on the curve while maintaining a constant angle relative to a line tangent to the curve at each point along the curve.

According to a fifth embodiment, the present invention provides a device for offsetting neck borne weight comprising: (a) a head member, wherein the head member comprises (i) a head association structure, and (ii) a pivot mount; and (b) an arm assembly, wherein the arm assembly comprises (i) an upper member, wherein the upper member is associated with the pivot mount, and (ii) a lower member, wherein the lower member has an upper end and a lower end and the lower member is associated with the upper member at the upper end of the lower member.

Various embodiments of the present invention provide alternative solutions to address the problems associated with the weight of head borne devices. Additionally and as will be understood by persons of ordinary skill in the art, various features of the different embodiments, even when not explicitly illustrated as being used in combination, can be combined as part of devices within the scope of the present invention.

In some embodiments, the present invention reduces the amount of weight a person's neck must support, regardless of whether that weight is from a heavy helmet itself, one or more helmet mounted devices or a helmet in combination with one or more helmet mounted devices such as night vision goggles. Additionally, in some embodiments, the present invention has a functionality that is insensitive or having sufficiently low sensitivity to loads that are added to or removed from the front of a helmet, and otherwise would upset the weight balance of the helmet. Furthermore, in some embodiments, the present invention stabilizes a helmet while a person performs activities such as walking, jogging, bending, or running, by restricting the range of movement of the head. Additionally or alternatively, in other embodiments, the devices of the present invention offer one or more if not all of the following benefits, operating well either in an upright or prone position, being lightweight, increasing minimally the silhouette of the person wearing it, and being quickly removable either by the user, or upon being snagged on an object such as a tree branch.

Still further, in some embodiments, the present invention stabilizes and centers a person's head to the upright position, provides a way to offset the weight of a person's head, and/or provides a vertical force on the neck to provide traction. In alternative embodiments, instead of connecting to a helmet, the load offsetting device may connect to a cap and/or a system of straps, which in turn are connected to a person's head, and provide a connection location for the load offsetting device, thereby offsetting the weight of the person's head, as opposed to a helmet or other head borne device. In these cases, the device can be configured to more than offset the weight of the head and thereby provide a vertical pulling force on the neck. Thus, a device of the present invention may allow for movement while rehabilitating the neck from neck disorders including traumatic neck injuries. Moreover, the device may be configured for humans as well as for animals, thereby rendering it useful in the veterinary field e.g., to help to rehabilitate animals.

BRIEF DESCRIPTION OF THE FIGURES

For a more complete understanding of the invention, reference is made to the following description and accompanying figures.

DETAILED DESCRIPTION

Reference will now be made in detail to various embodiments of the present invention, examples of which are illustrated in the accompanying figures. In the following detailed description, numerous specific details are set forth in order to provide a thorough understanding of the present invention. However, unless otherwise indicated or implicit from context, the details are intended to be examples and should not be deemed to limit the scope of the invention in any way.

According to a first embodiment, the present invention is directed to a device for offsetting weight of head borne equipment. The device comprises a helmet and an arm assembly. The weight that is to be offset may be that of the helmet itself, other devices associated with the helmet or a combination of the weight of the helmet and other devices.

Figure 1:
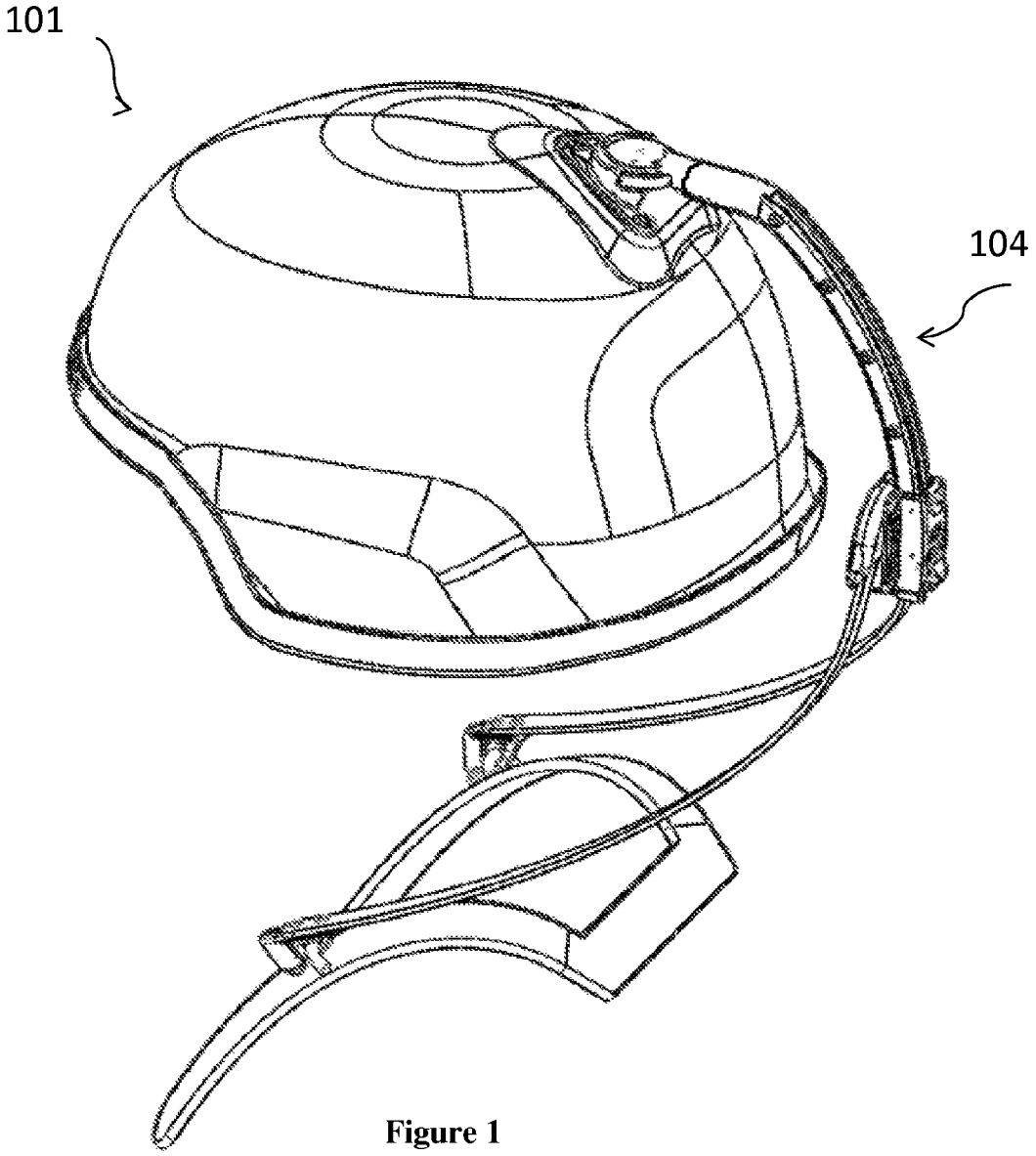
FIG. 1 is a representation of a device in accordance with an embodiment of the present invention.
Figure 13:
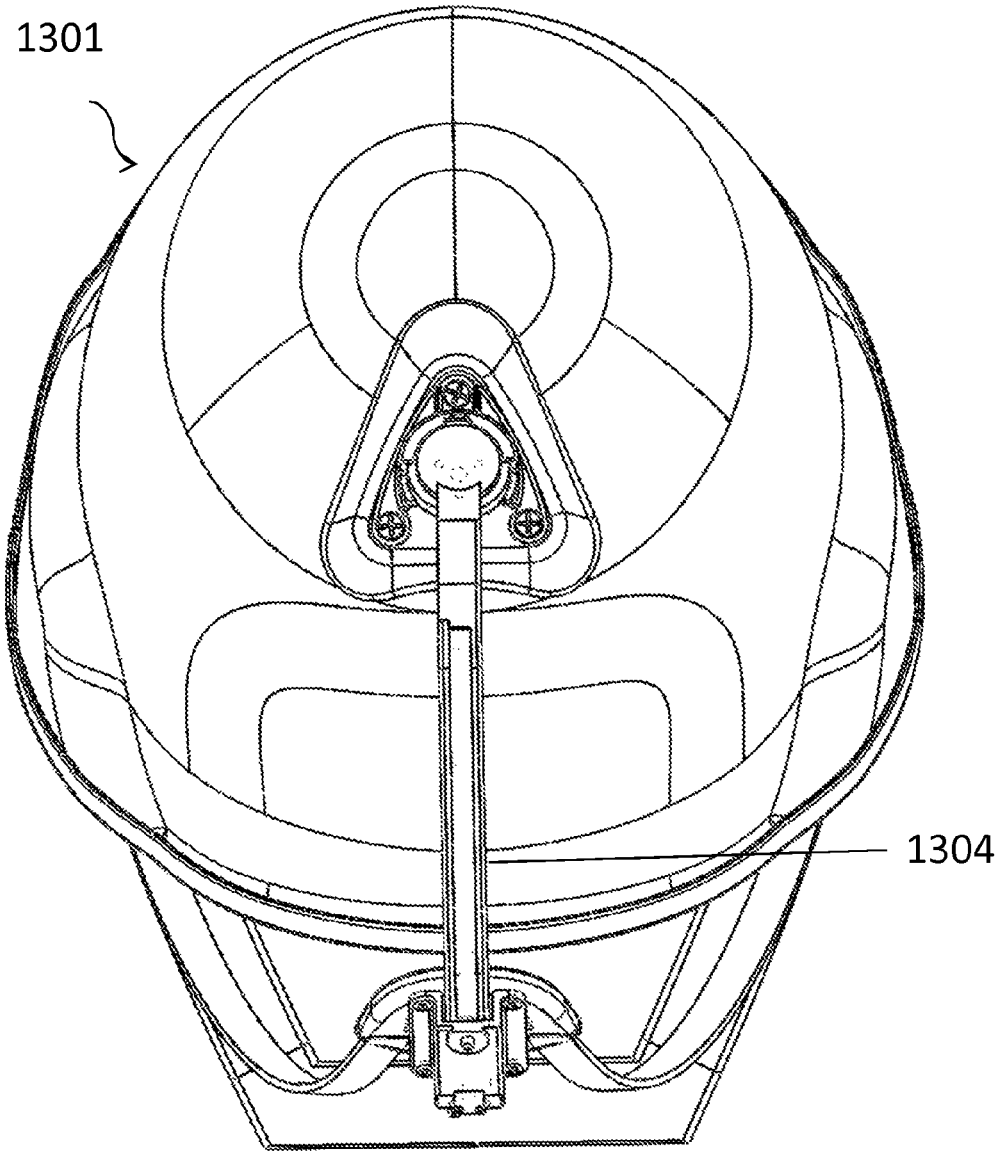
FIG. 13 is a representation of a top view of a device of the present invention.
Figure 14:
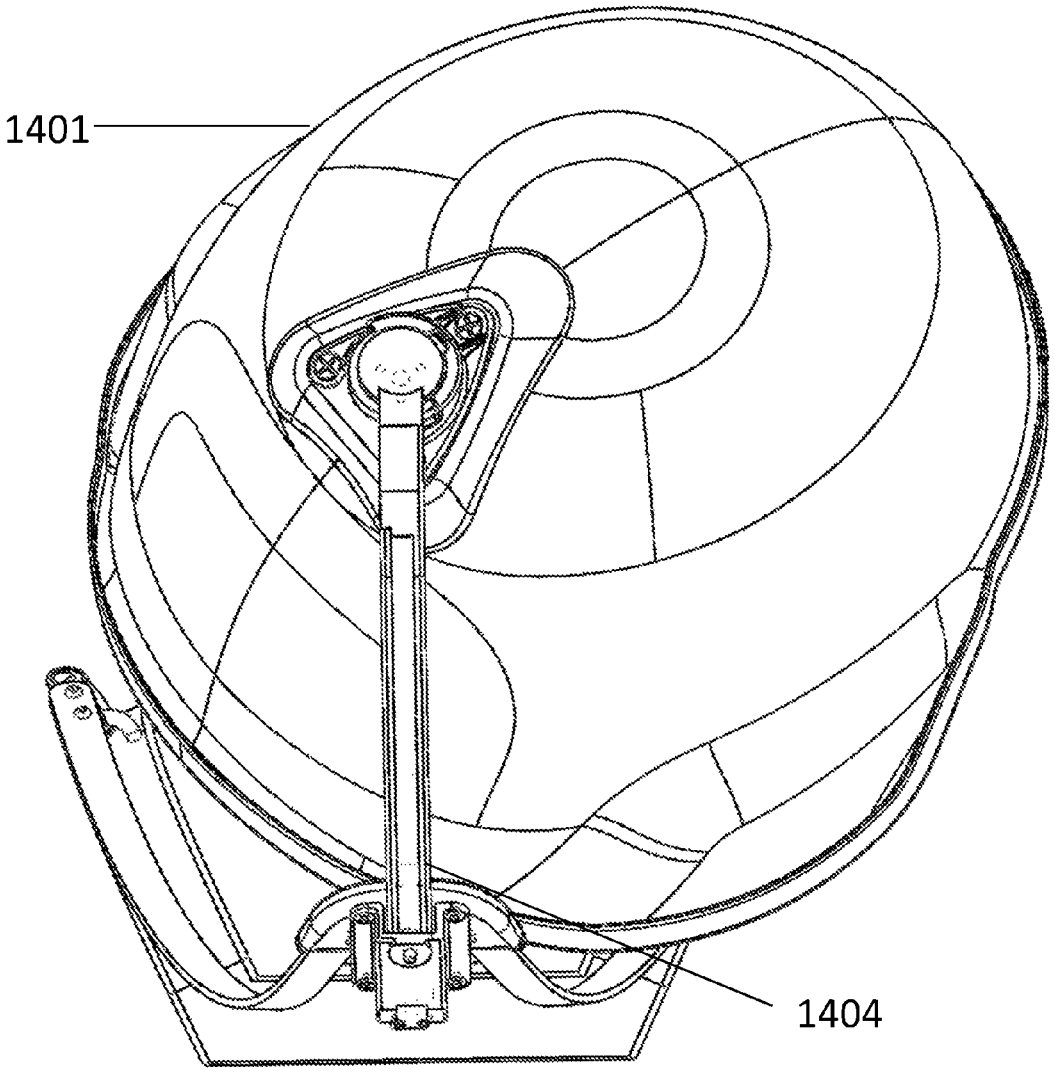
FIG. 14 is a representation of a top view of a device of the present invention with the head yawed to the right.

FIG. 1 provides an example of a device of the present invention and the relationship between a helmet 101 and an arm assembly 104. FIG. 13 shows the helmet 1301 with the same arm assembly 1304 of FIG. 1 from a different view. FIG. 14 shows the device from the same view as in FIG. 13, but with the helmet 1401 turned to the side relative to the arm assembly 1404.

The helmet may be any structure that is configured to rest on a person's head. By way of non-limiting examples, a helmet may be a military helmet (e.g., a combat helmet), a firefighter helmet, a fighter pilot helmet, a baseball helmet, a football helmet, a hockey helmet, a police helmet, a bicycle helmet, a motorcycle helmet, a construction helmet, an astronaut helmet, a scuba diving helmet, a bomb disposal helmet, a device for an animal, e.g., a horse, monkey, chimpanzee or dog, a head arm/traction arm device, a mining helmet, or any other head mounted devices. The purpose of the helmet may be for protection or it may be to provide a means to transport other devices or a combination thereof. In some embodiments, the helmet covers at least 40%, at least 50%, at least 60%, at least 70%, at least 80%, at least 90% or at least 95% of the surface area of a person's scalp. The helmet may or may not have a face guard or a protective screen for the user's face. Furthermore, in some embodiments, there may be a chin strap to assist in securing the helmet to the user's head.

In some embodiments, the helmet may comprise, consist essentially of or consist of metal, a metal alloy, ceramic, fiber composite material, plastic or a combination thereof. The internal surface of the helmet may or may not contain a cushioning material such as padding.

Figure 2:
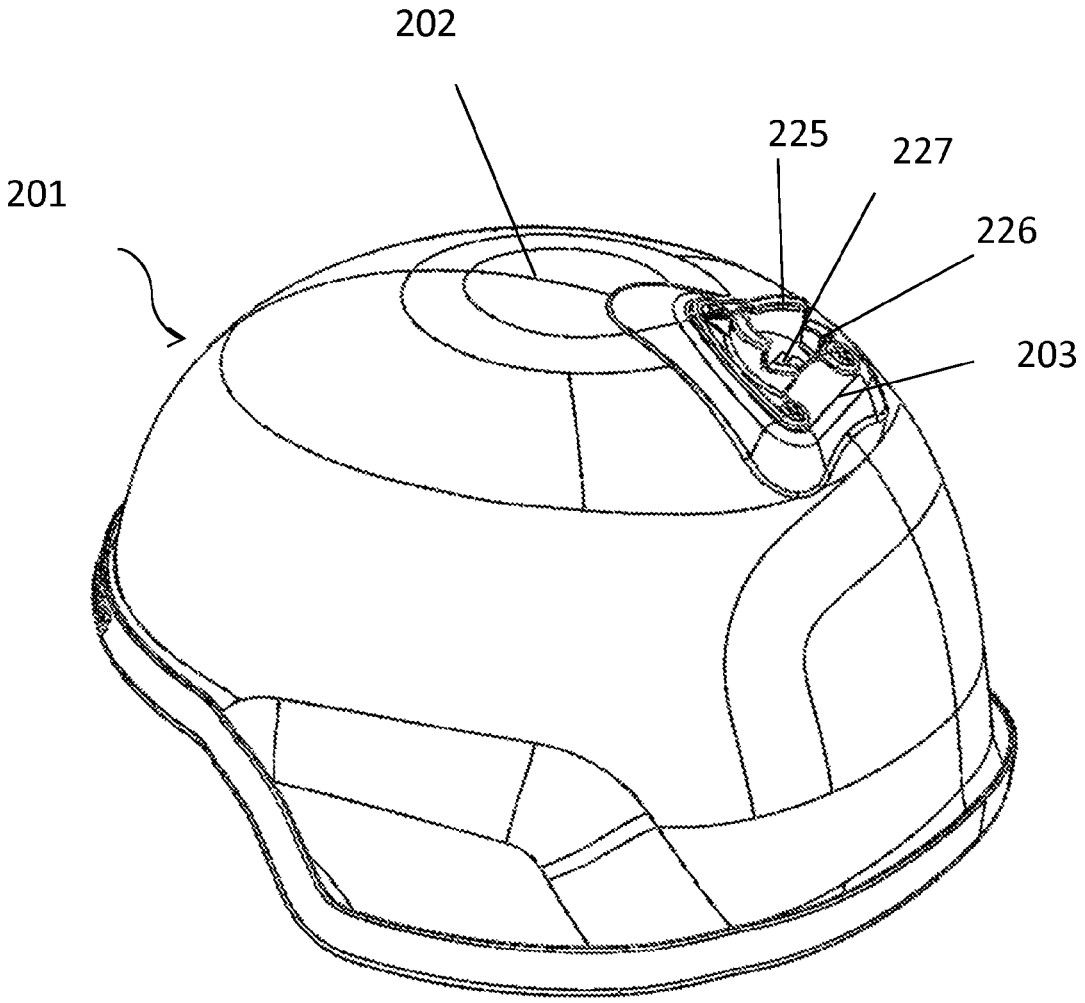
FIG. 2 is another representation of a helmet that may be used in a device of the present invention.

FIG. 2 provides additional detail of a helmet 201 according to the present invention. The helmet has a body 202 that is configured to cover a section of a person's head, including the top of the head and the sides down to at least ear level. It also has a helmet pivot mount that is affixed to the body of the helmet through, e.g., screws, rivets, mechanical interlocking shapes, glue, and/or other adhesive materials. In one embodiment, the helmet pivot mount comprises or is part of a pin joint. Preferably, the helmet pivot mount is permanently affixed to the helmet and under normal wearing conditions will not separate from the helmet. Furthermore, preferably the mount is bonded to the helmet in order to avoid compromising the ballistic properties of the helmet, but any hardware such as screws, nuts or bolts that are used to affix the helmet pivot mount to the helmet body do not protrude through to the inner surface of the helmet or are covered by padding so that they do not touch a wearer's scalp.

For convenience, the helmet pivot mount is described as part of the helmet. However, as a person of ordinary skill in the art will recognize, because it is the location at which the helmet body connects to the arm assembly, one or more components of the helmet pivot mount can be described as part of the arm assembly. By way of a non-limiting example, the hardware of the helmet pivot mount may include one or more if not all of the following: a receiver 203, an overhang 225, a ledge 226 and a detent groove 227. This hardware, in combination with the arm assembly, determines the degrees of freedom around which the assembly arm will be able to pivot. As noted above, an alternative structure for allowing pivoting between a helmet and an arm assembly is a pin joint. In a pin joint, the helmet pivot mount may comprise a pin or a screw that is affixed to the helmet and have a head and body, wherein the head is wider than the body and the body is located between the outer surface of the helmet and the head of the pin. The arm assembly may have an opening that is wider than the body of the pin, but narrower than the head of the pin, and the body of the pin may be situated within this opening. When the user turns his or her head left or right, the arm assembly may pivot in response at this pin joint while still providing a transfer of load to the user's shoulders.

In some embodiments, the assembly arm is reversibly connected to the helmet pivot mount. Thus, it may be releasable and able to reengage the receiver. Helmet receiver 203, shown in FIG. 2, is formed to accept rotating element 305 of the arm assembly of FIG. 3 in a releasable connection. When connected to the helmet receiver 203, rotating element 305 is fixed relative to the helmet 201. This is accomplished with a shaped receiver housing that partially envelops rotating element 305. Overhang 225 engages the top front and front surfaces of the rotating element, and ledge 226 engages part of the bottom rear of rotating element 305. Between the overhang 225 and ledge 226, rotating element 305 is prevented from moving forward, left or right, and also prevented from rotating in roll, or pitching up. The rotating element is prevented from pitching down by virtue of the ledge contacting near the middle of its upper surfaces and its front underside making contact with the receiver. A spring ball plunger located on the underside of the top of upper member engages a detent groove 227 in receiver 203. The location of the ball detent is coincident with the axis of rotation of rotating element 305. The detent connection formed by the spring ball plunger, and the detent groove 227 serves to prevent the rotating element 305 from accidentally disengaging from receiver 203. However, it allows rotating element 305 to be removed by the user if the arm assembly is pulled out hard enough in a straight backwards direction, or if the arm assembly is caught on a snag hazard such as a tree branch.

Figure 3:
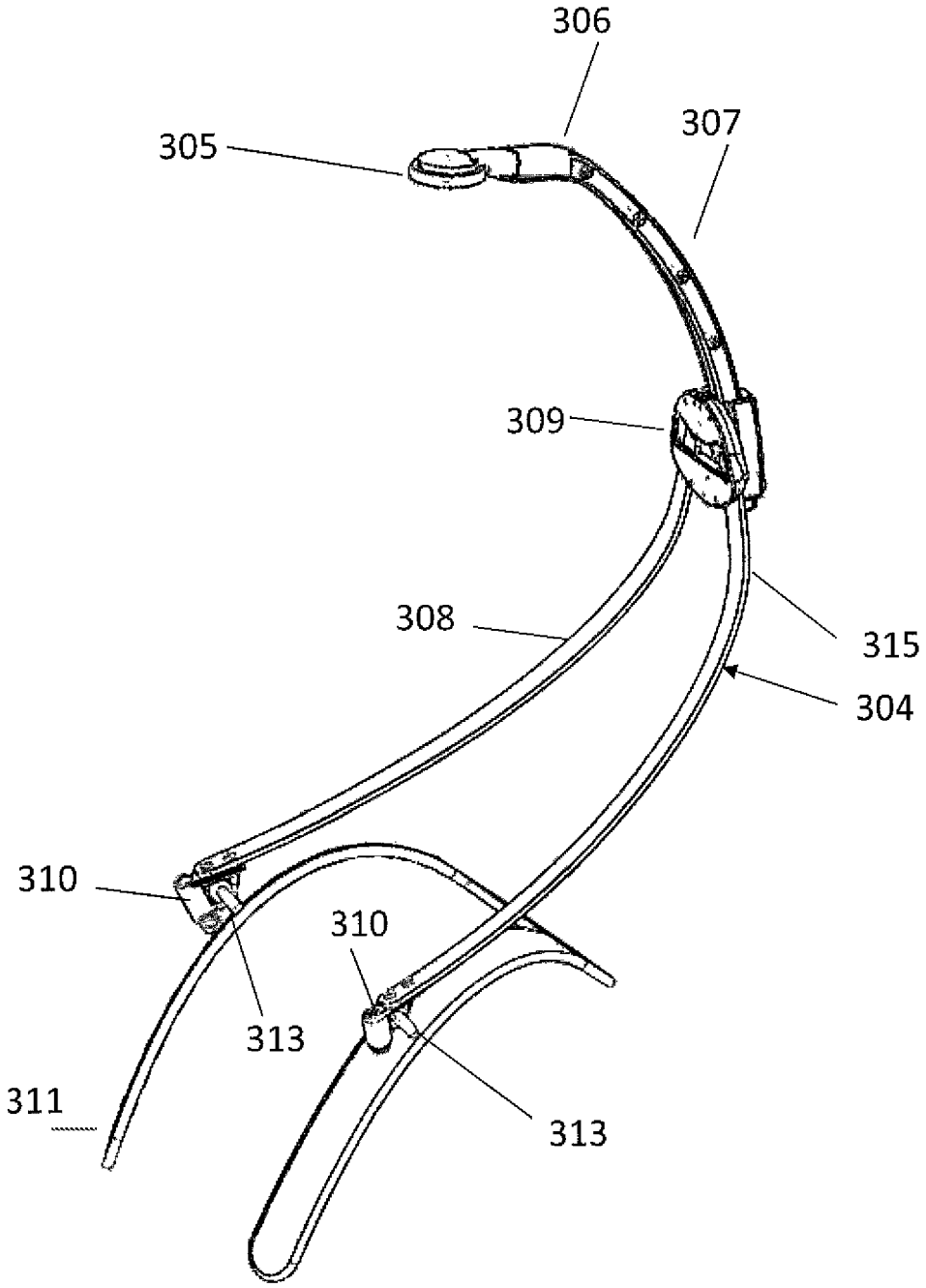
FIG. 3 is a representation of an arm assembly connected to a shoulder brace.

The arm assembly 304 comprises an upper member 307, a right lower arm 308 and a left lower arm 315 as shown FIG. 3. The upper member has a first end 306, which is the end through which the upper member connects to the helmet via the helmet pivot mount. As noted above, a non-limiting example is a rotating element 305. When in use, movement of the rotating element relative to the helmet pivot mount enables the wearer of the device to move his or her head while still distributing weight from the helmet and any auxiliary devices associated with the helmet. Of the six possible degrees of freedom between the receiver and the arm 307, the only one that is not fixed firmly in this connection is the yaw axis. The arm assembly consists of a rigid arm with the inner race of a crossed roller bearing fixed at its end. The outer race of this bearing engages the receiver in the manner described above. The nature of such a bearing is that it allows only one degree of freedom between the inner and outer race. In this case yaw is allowed, but no other rotation or translation is allowed. The allowable yaw is limited by the structural requirements of the overhang 225 and of the head of the arm, which mounts the bearing. In this embodiment, the allowable yaw rotation of this joint is approximately 60-80 degrees, e.g., 75 degrees each way from center, and that has been found to be sufficient for a feeling of free yaw rotation of the helmet for users.

Figure 15:
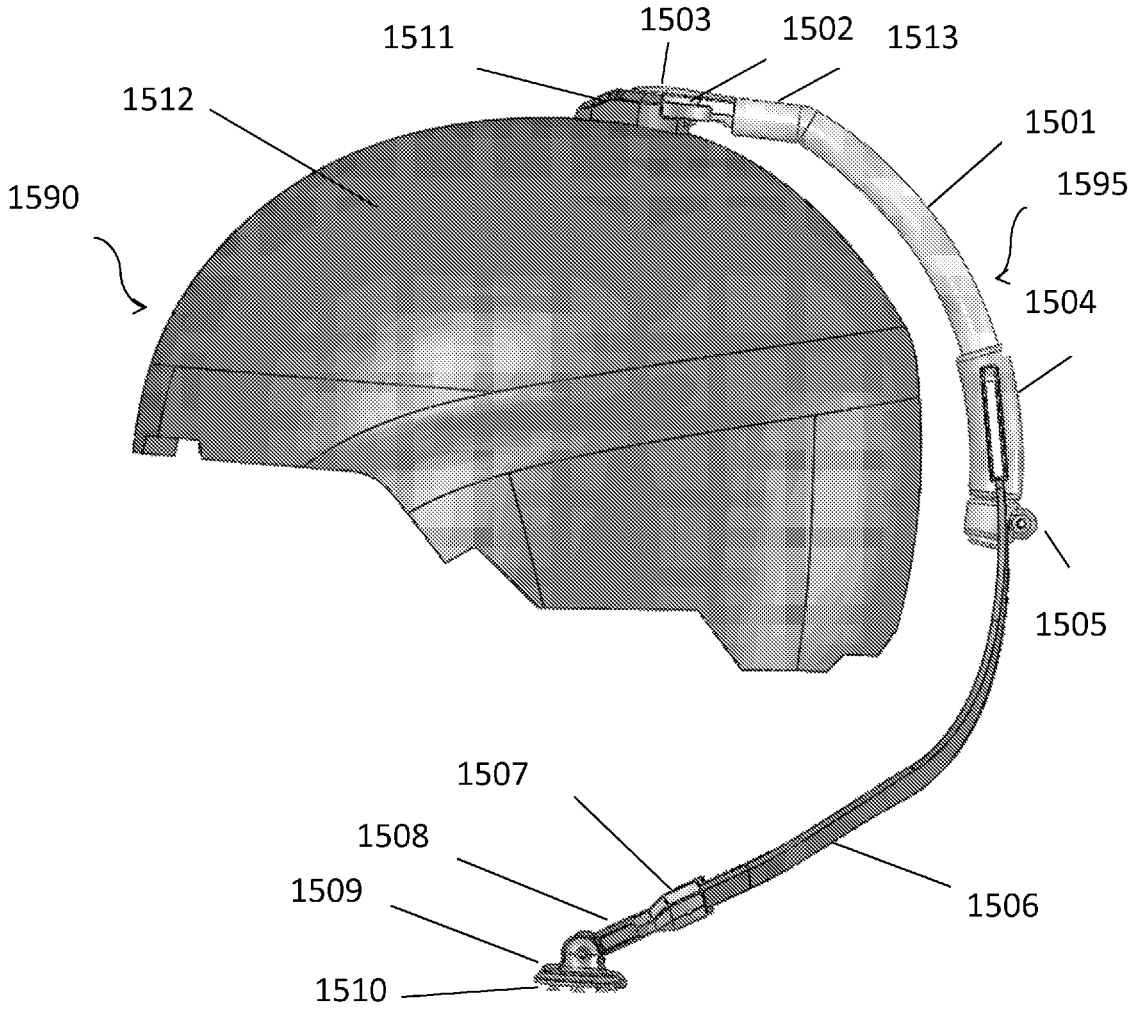
FIG. 15 is a representation of another embodiment of the present invention.

Alternative embodiments incorporate a roll axis pin joint into the first end 306 of the arm, allowing the entire first end and rotating element 305 to rotate freely in the roll axis relative to the rest of the upper member 307. For example, FIG. 15 shows that the head of arm 1502 can rotate in the roll axis relative to arm 1501 by means of a plain bearing located inside the arm at location 1513. The rotation is not limited by the joint, but as a practical matter, there is very little rotation of this joint in use. Additionally, it does help to make the helmet move more naturally with the movements of a user's head, and does not negatively impact the load offsetting functionality of the device because this roll rotation axis is perpendicular to the direction of the load offsetting force.

The upper member may be completely or partially straight or curved, and it may be completely or partially solid or hollow, optionally containing additional hardware that facilitates the benefits of offsetting the weight of head borne devices of the present invention. In some embodiments, the upper member 307 of the arm assembly is rigid.

The lower portion of the arm assembly consists of two flexible members that may referred to as the right lower arm 308, and the left lower arm 315. The term "arm" does not limit the configuration or material. Each of the right lower arm and the left lower arm has an upper end and a lower end. The upper ends of the right lower arm and the left lower arm are the location, at which they are associated with the upper member. Association of the right lower arm and the left lower arm may be through direct attachment to the upper member or attachment to the upper member through one or more other structures. The location of attachment between the upper ends of the right lower arm and the left lower arm to the upper member may be referred to as a connection point that optionally contains an intra-arm assembly connector 309. As shown in FIG. 3, when the right lower arm and the left lower arm converge at a connection point, and there is a single straight or curved structure that provides the length to the upper member, the device may be described as having an inverted "Y" form.

In the arm assembly as shown in FIG. 3, each of the right lower arm and the left lower arm contains a connector 310, which may, for example, be referred to as a right shoulder pivot mount and a left shoulder pivot mount, respectively or it may contain a piece that interacts with a shoulder pivot mount that is part of a shoulder element around which the lower arms pivot. For reference, also shown in FIG. 3 is a shoulder element in the form of a shoulder yoke 311, which contains a receiving apparatus 313, which is configured to permit attachment of connectors 310. The connectors 310 may be glued, screwed, molded in, clamped, pinched, or enveloped with respect to flexible members 308 and 315.

An adjustment method may further be provided that allows for selective positioning of connectors 310 on flexible members 308 and 315 in order to adjust for different body types and weight offset requirements. For example, a series of holes can be provided in the flexible members to allow them to be connected in different places in order to create different effective lengths. Additionally, in some embodiments, the flexible members can be provided in various standardized sizes and swapped with each other to adapt the system to different ergonomic and load requirements.

In other embodiments, one starts with "long" versions and uses a tool or device in order to cut it down to the desired size and also to create any required mounting holes. Examples, of tools or devices that one may use for this function include but are not limited to a shear, punch, saw, drill would be effective. Another embodiment of the invention may collapse so storage may further be provided. For example, a hinge can be provided in the flexible member that allows folding away from the direction of flex, similar to the arm hinge depicted in FIG. 7. In this way, the flexible members can be folded back to align with the rigid arm 307. The inter-arm connector assembly 309 can be configured with hinges at the connection points with the flexible members to allow for the flexible members to be moved more parallel to each other, bringing the connectors 310 close to each other, and/or hinging can be provided to allow the flexible members to be rotated back in a manner similar to that described above, aligning the flexible arms with the arm 307.

The connection created between the connectors 310 and receiving apparatuses 313 allows the lower portion of the flexible member (the lower arms) to rotate freely, within limits, on three axes. This connection allows relative rotation between the elements. For example, in some embodiments, pitch down may be limited by an adjustable screw located in connector 310 that strikes the face of mounting collar 311 when the angle of the flexible member is approximately 45 degrees from horizontal. In other embodiments there is no limit on pitch down.

Pitch up may have no controlled limit in the connection itself. Nevertheless, as a practical matter, it may be limited by the flexible member making contact with the user's shoulder, or the mounting device 311. Approximately 10 or 20 degrees of yaw is allowed in this embodiment due to the loose fit between the connecting elements, but in other embodiments there is no limit on yaw rotation.

In some embodiments, roll rotation may be limited to approximately 30 to 45 degrees each way. In other embodiments, there is no limit on roll rotation between the connection elements.

In some embodiments, translation is not allowed on any axis. When translation is prohibited, the connector 310 is not allowed to move a substantial distance relative to the receiving apparatus 313 in any direction, such as forward/back, up/down, or left/right. Other embodiments of the invention may use a snap, clip, slide, latch and hook attachment, hinge, heim joint or other connection type at these locations. In some embodiments, there is a front limit on the pitching rotation in order to improve performance and comfort when looking down.

Figure 22:
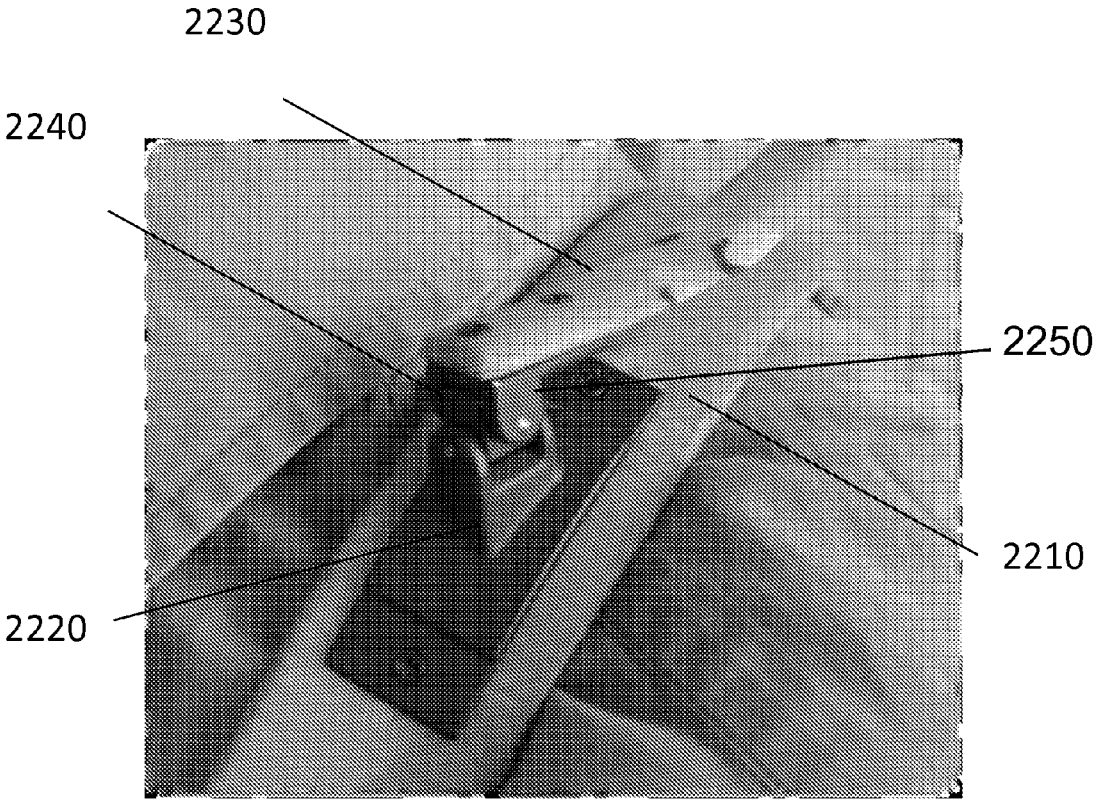
FIG. 22 is a representation of a shoulder pivot and shoulder pivot mount.
Figure 23:
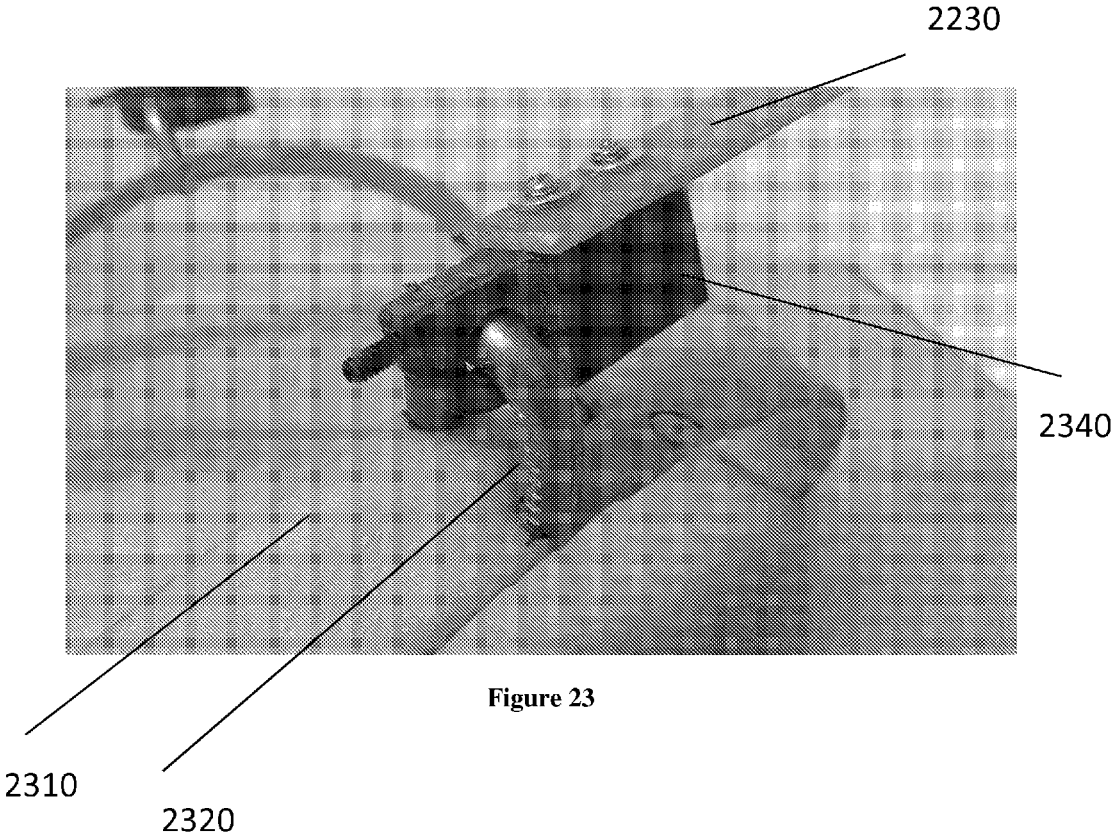
FIG. 23 is a representation of another shoulder pivot and shoulder pivot mount.

An example of a shoulder pivot mount and connector in the form of a typical universal joint is provided in FIG. 22. In that figure, to a backpack strap 2210, a receiving clevis 2220 is affixed. The left lower arm 2230, has at its terminus, a shoulder clevis 2250. A spider 2240 connects the clevis elements to each other through mutually perpendicular hinge joints. The resulting connection allows pitch and roll freedom, but no yaw or translational freedom. Another example of a shoulder pivot mount and connector appears in FIG. 23. In that figure, to a backpack strap 2310, a connector in the form if a U element 2320 is affixed. The left lower arm 2230, has at it terminus, a shoulder pivot mount 2340 that permits pivoting along the roll axis. The hole in the shoulder pivot mount is slightly larger than the diameter of the rod forming the U element, and thereby allows about 10 degrees of yaw freedom in each direction. The shoulder pivot mount can also slide left and right along the U element, allowing up to 90 degrees of roll freedom in the joint.

Turning back to FIG. 3, flexible members 308 and 315 may be straight or angled inward or outward and flat or twisted their unloaded state. They are depicted in FIG. 3 in a shape that they might assume when they are counteracting the load of a helmet. In order to illustrate the arm assembly, the helmet is not shown in this figure. As a result of the spring force from arms 308 and 315, rotating element 305 and/or intra arm-assembly connector 309 is able to exert an upward force on the helmet.

In various embodiments, a helmet pivot mount is descried as part of the helmet and a shoulder pivot mount is described as part of each of the left lower arm and the right lower arm. However, the helmet pivot mount can alternatively, be part of the upper member so long as the reciprocal hardware from the upper member is included on the helmet. Similarly, the shoulder pivot mounts can be part of the shoulder element rather than the lower arms so long as the reciprocal hardware is part of the arms.

Referring again to FIG. 3, in the embodiment shown rotating element 305 will be firmly engaged with the helmet pivot mount, not shown, and by virtue of element 305 being comprised of the outer race of a crossed roller bearing, and the arm assembly being firmly connected to the inner race of said bearing, the arm assembly 307 would be constrained to be capable of rotating only on a substantially vertical axis parallel to the neck. This allows the user to look freely left and right (see FIG. 13 in which helmet 1301 is in line with arm assembly 1304, FIG. 14 in which the helmet 1401 is turned in relation to FIG. 4). In the embodiment of FIG. 3, the rotating element 305 is the outer race of a crossed roller bearing. It may also be formed with a pair of thrust bearings, a deep groove ball bearing, or another type of rolling element bearing. The rotating element is preferably secured into place in the receiver by a spring ball detent. Other embodiments of the invention may include one or more top connections that allow control of roll.

Some embodiments also contain breakaway capabilities between the helmet and arm assembly. This breakaway capability may be provided by a rotating element separating from receiver, a tube separating, or a bracket separating from the helmet. Other embodiments of the invention may mate the various connections using a snap, clip, screw, latch and hook connections (e.g., Velcro®), hinge or other connection types between the upper member and the helmet.

Other embodiments of rotating elements may have one or two degrees of rotational freedom that provide the ability to swivel and to tilt at the site of the connection. Degrees of rotational freedom may be created through load bearing elements such as a hinge pin, one or two ball bearing(s), two thrust bearings, flextures, or a crossed roller bearing or a combination thereof. The connection between helmet and arm assembly may also have elements that allow it to slide along the ridge of the helmet to increase prone position comfort. For example, a curved track can be fixed to the helmet and the arm receiver can be incorporated into a follower that is constrained to engage the track and move along it with a single degree of freedom. In some embodiments, the pivot locations of the connections and the wearer's head are such that the two yaw similarly, meaning that the yaw axis of the pivot and the natural yaw axis of a person looking left and right are substantially parallel. In addition, if these two yaw axes are close to each other (for example within 5 centimeters of each other) then there is much less need for compliance in other parts of the system during this type of movement.

Connection assemblies are preferably be preassembled. However; in some embodiments of the invention the user may put together any and all connections.

Figure 4:
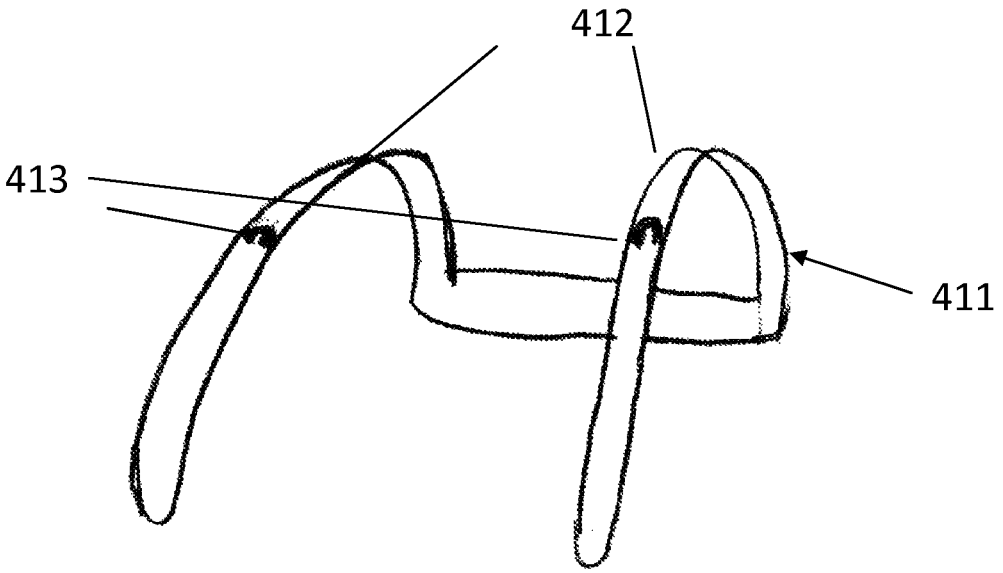
FIG. 4 is a representation of a brace for a person's shoulders.

FIG. 4 provides an illustration of an example of a shoulder element 411 in isolation. It has curved shoulder rests 412 that sit on a person's shoulder, as well as receiving apparatus elements 413 around which the left lower arm and the right lower arm may pivot. Receiving apparatus elements are shown as bracket connectors and are adapted to receive mating flexible member shoulder pivot mounts (not shown in FIG. 4). The shoulder element is preferably made out of fiber or wood composite materials, but can also comprise, consist essentially of or consist of plastic or metal or a combination thereof.

Other embodiments of a shoulder element include, but are not limited to: body armor, a backpack, an oxygen tank, a flight jacket, shoulder pads, webbing, an equipment jacket, a vest or anything tightly secured anywhere below the head. The shoulder element, which may be part of or form a body mounting platform is fixedly or removably attached to the user's body. Other embodiments of the invention comprise, consist essentially of or consist of an additional piece to secure the body mounting platform tightly to a user's body.

At connection point 309 (see FIG. 3), there may be a connector that is within the arm assembly and thus, may be referred to as an intra-arm assembly connector. This connector may be configured such that it is movable along the length of the upper member or so that it prevents movement along the length of the upper member. Thus, in one embodiment, the upper member comprises an intra-arm assembly connector, wherein the left lower arm is associated with the upper member at the intra-arm assembly connector, and the right lower arm is associated with the upper member at the intra-arm assembly connector, and the device is configured such that when a force is exerted on the arm assembly by a user, the distance from the helmet pivot mount along the upper member to the intra-arm assembly connector remains constant. In another embodiment, the upper member comprises an intra-arm assembly connector, wherein the left lower arm is associated with the upper member at the intra-arm assembly connector and the right lower arm is associated with the upper member at this connector, and the device is configured such that when a force is exerted on the arm assembly by a user, the distance from the helmet pivot mount along the upper member to the intra-arm assembly connector changes. In the latter embodiment, the device may be configured such that the arm assembly forms, comprises, or acts as a spring.

In some embodiments, the intra-arm assembly connector is in the form of a bearing assembly and comprises or acts as a bearing follower on the curved upper member 307 of the arm assembly. When the connector acts as a bearing assembly, the distance between it and the first end of the upper member can change. This change will, for example, occur when a user tilts his or her head upward. As shown in FIG. 3, the curve 307 may be a true arc, and the bearing follower 309 may be capable of traveling along the curve with one degree of freedom, guided by low friction bearings. Alternatively, the curve can be one of varying radius, which would allow the center of curvature (and thereby of helmet support) to vary as the bearing assembly moves along the curved upper member.

Figure 9:
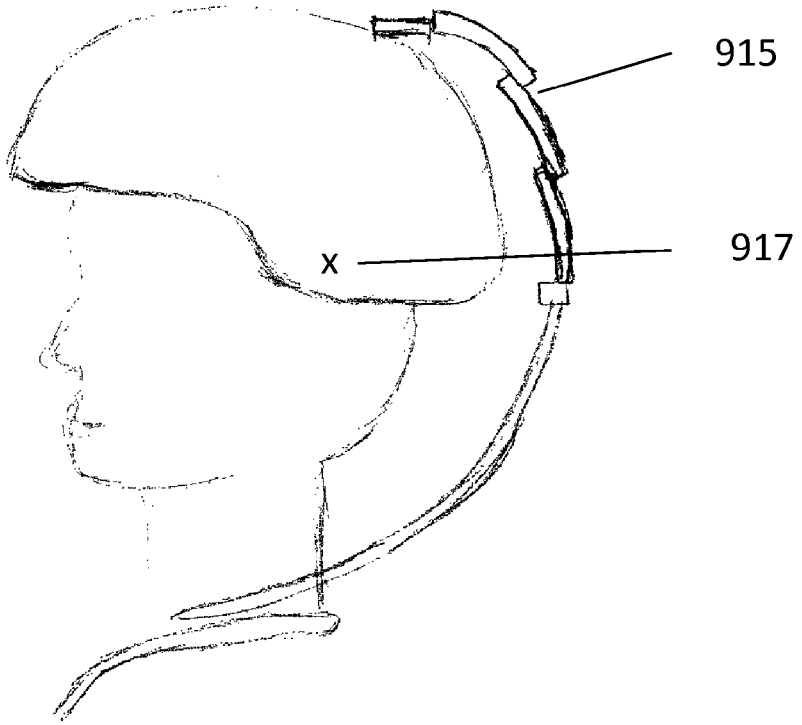
FIG. 9 is a representation of another embodiment of the upper portion of the arms of the present invention, wherein the upper arm stacks in an arcuate fashion.

In some embodiments, the upper member has an arc center. Element 917 in FIG. 9 shows the relative position of this arc center. Although the figure shows an x at this location, the "x" is for illustration purposes, and the device need not contain the denotation. Additionally, as persons of ordinary skill in the art are aware, the arc center refers to the point in space that is equidistant from all points on the arc. This arc curvature may be defined by a radius that is the distance from the upper member to the desired point at which helmet support will be provided. This radius is approximately 8 cm to 15 cm, e.g., about 10 cm for a typical user. This point optimally lies on a vertical line that is near the center of gravity of the helmet so that the line of action of the vertical lifting force of the device is close to the center of gravity of the helmet and thereby lifts the helmet evenly. Additionally, in some embodiments, it may be desirable to keep the upper arm small and close to the helmet. If the curvature of the upper member is nearly concentric with the helmet shape, then the space occupied by the device will be minimized.

The upper member, when in the shape of an arc, may, for example, form a curved version of a linear guide track. This linear guide track may for example, comprise a rolling track bearing. In some embodiments, the device comprises two thrust bearings that permit the arm assembly to pivot at least 75 degrees each way from center at the helmet pivot mount. These thrust bearings may, for example, be part of or associated with or attached to the arm assembly.

Figure 5:
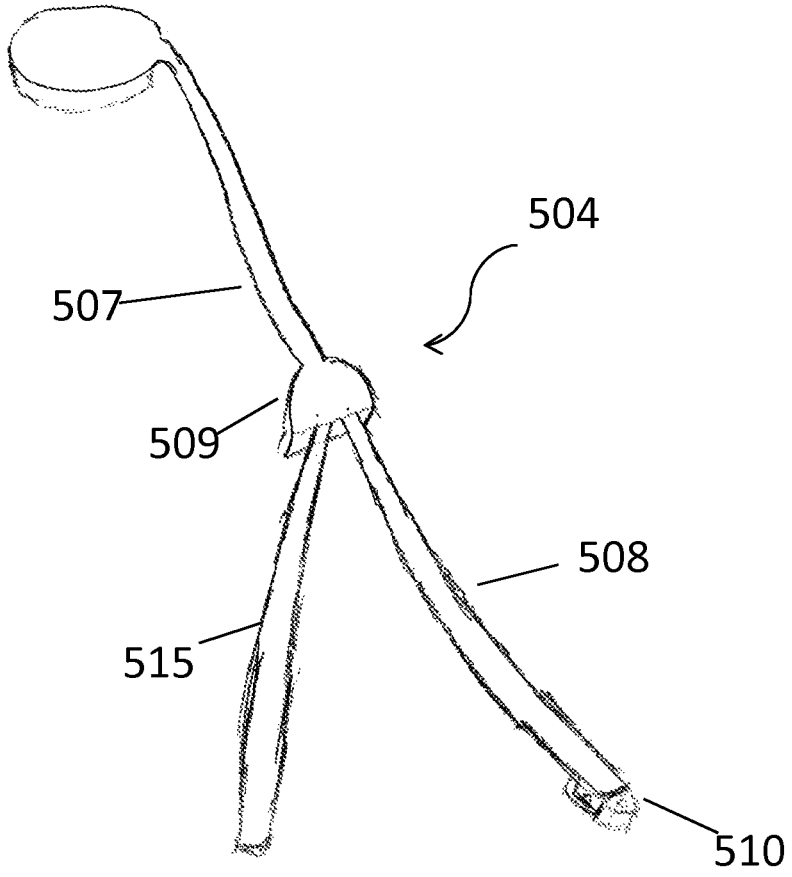
FIG. 5 is a representation of an arm assembly of another embodiment of the present invention.

Referring next to FIG. 5, another embodiment of an arm assembly 504 is provided. In this embodiment, the upper member is straight 507. The flexible members 508 and 515 may each have a rectangular cross section, but in alternative embodiments, they each may have a circular, oval, or various polygon-shaped or irregular cross sections. As depicted, there is an inverted Y shaped junction; other embodiments may have inverted V or inverted U shapes. Also shown is an intra-arm assembly connector 509 that forms the portion of the upper member that connects to the lower arms, as well as a connector for a shoulder pivot mount 510.

Optionally, the helmets of the devices of the present invention further comprise an attachment element for an auxiliary device, wherein the attachment element for the auxiliary device is located in the front half of the helmet. In some embodiments, the attachment element for the auxiliary device is located in the front third or front quarter of the helmet. In one embodiment it is located in the center of the front of the helmet. The attachment element for the auxiliary device may be in the form of the standard helmet mount used on the US Army Advanced Combat Helmet. Other attachment elements that make use of one or more of male and female parts, snaps and clips may also be used. Preferably, the auxiliary device to be associated with the helmet has a reciprocal feature for association. In one embodiment, the auxiliary device is a pair of goggles, e.g., night vision goggles that are affixed to the helmet. The auxiliary device may be permanently affixed to the helmet or reversibly affixed to it such that engagement and disengagement between the auxiliary device and the helmet may be repeated without undesirably affecting the integrity of either the helmet or the auxiliary device.

Figure 24:
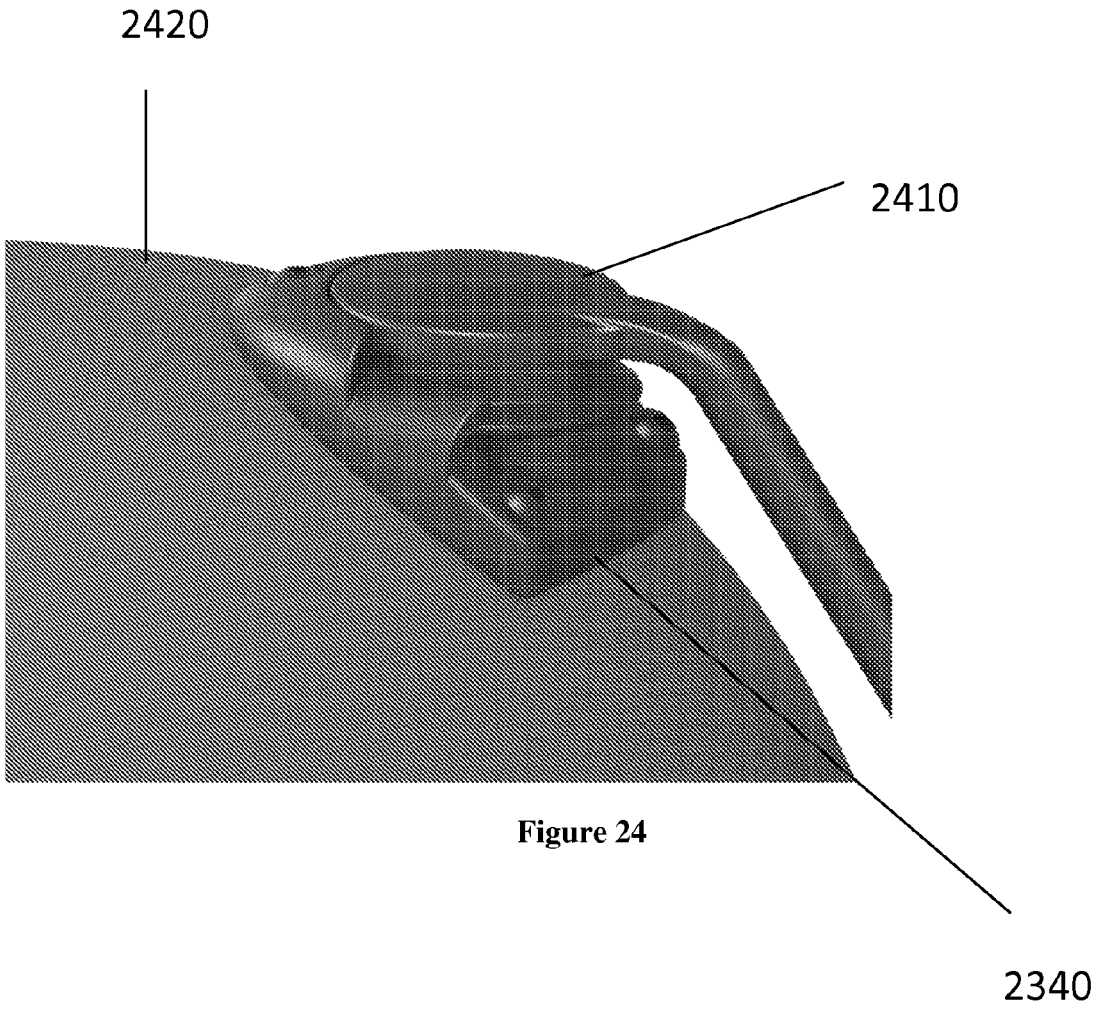
FIG. 24 is a representation of a close up of device in which a quick release element is associated with a helmet.
Figure 25:
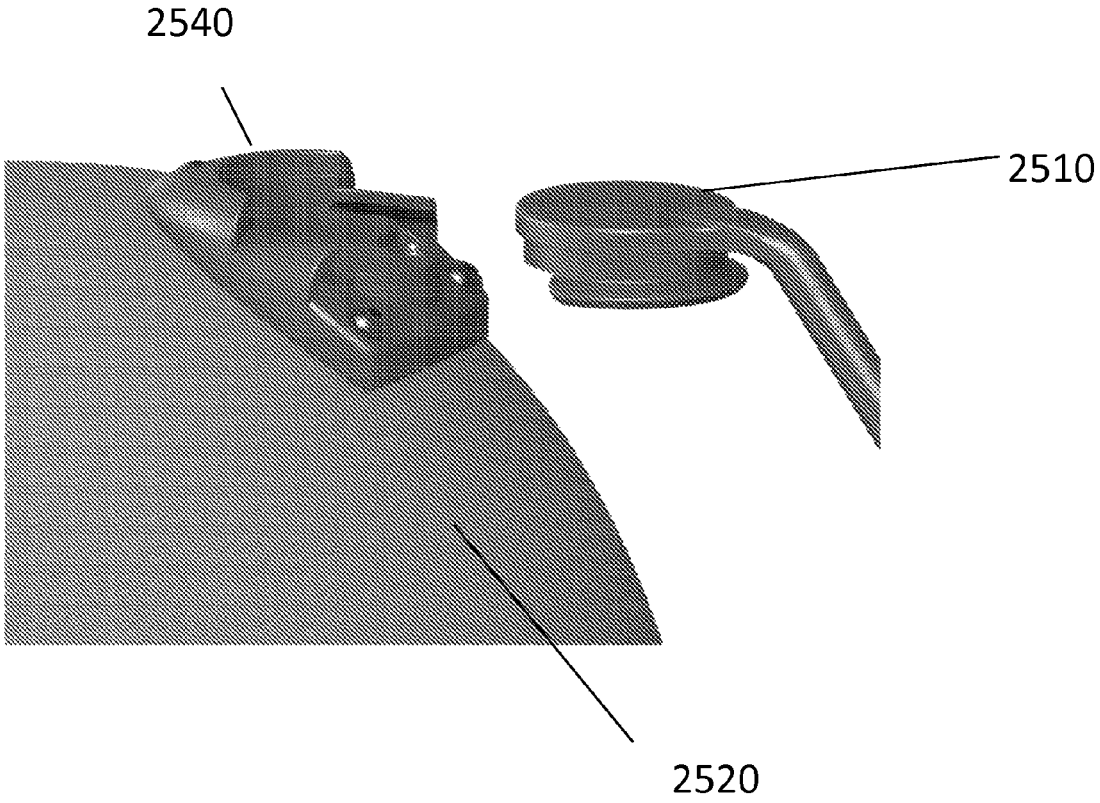
FIG. 25 is a representation of a close up of device in which a quick release element is disassociated with a helmet.

In some embodiments, the device of the present invention comprises a quick release mechanism, wherein the quick release mechanism permits disassociation between the helmet and the arm assembly at the helmet pivot mount. By way of example, the quick release mechanism may comprise bearing slots and a ball plunger and/or magnets. FIG. 24 provides a representation of close-up view of a device that contains an element capable of quick release 2410 as attached to helmet 2420 through the helmet pivot mount 2430. FIG. 25 shows the same component as FIG. 24 but the element of quick release 2510 of the upper arm is dissociated from the helmet pivot mount 2540 of the helmet 2520.

Figure 26:
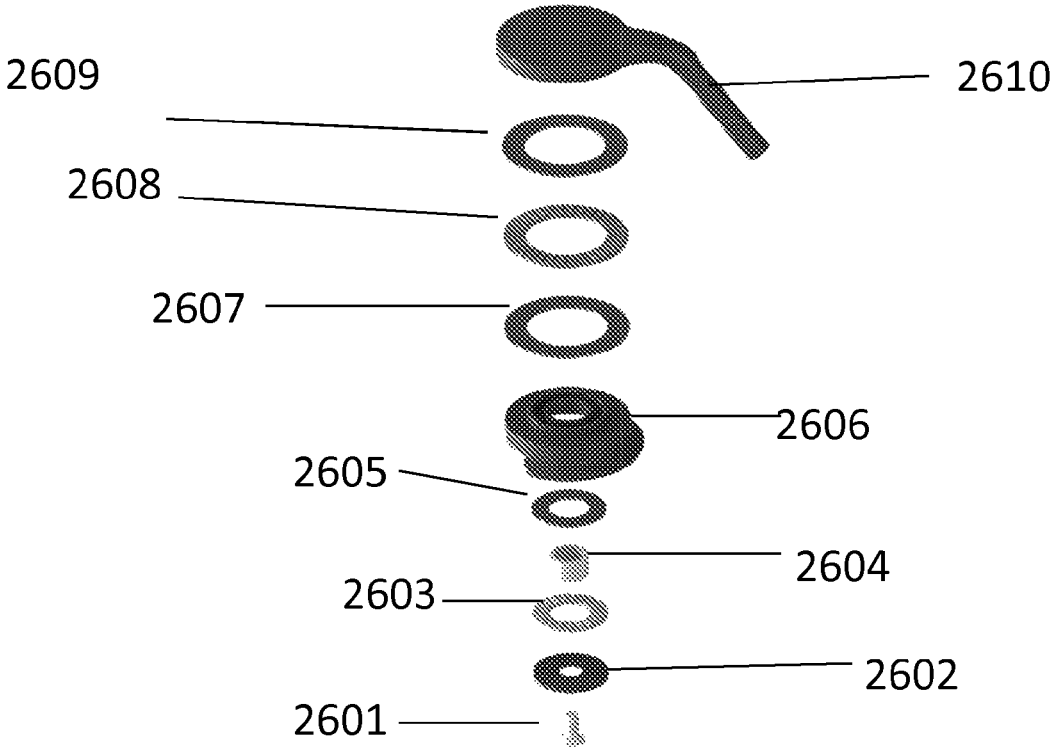
FIG. 26 is an exploded view of the components of a quick release mechanism.
Figure 27:
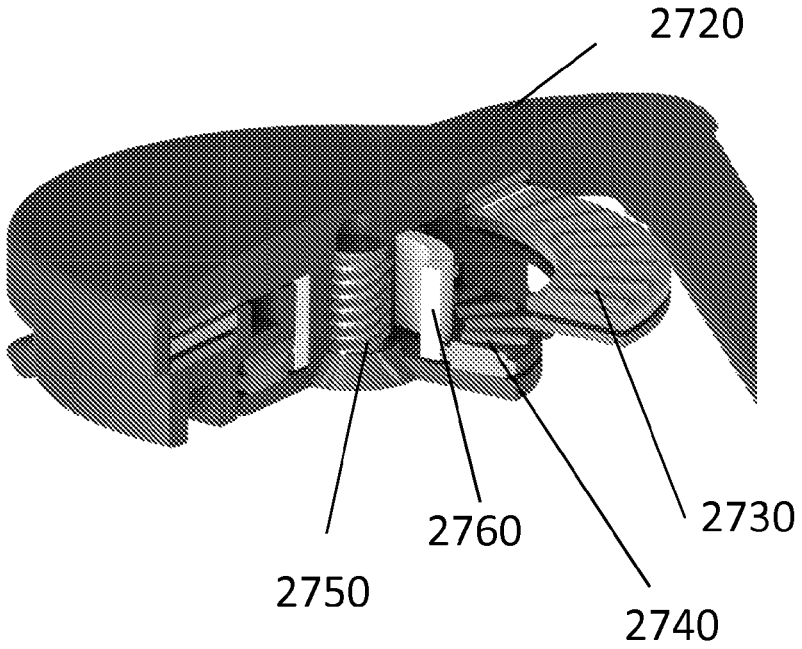
FIG. 27 shows a cross-section of the components of the release element of FIG. 26.

FIG. 26 provides an exploded view of the components of a quick release element that is associated with the upper arm. These components are screw 2601, lower small thrust washer 2602, small needle bearing assembly 2603, spacer 2604, upper small thrust washer 2605, rotating element 2606, lower large thrust washer 2607, large needle bearing assembly 2608, upper large thrust washer 2609, and upper element head 2610. The screw holds all of the bearing elements together by clamping the spacer between the lower small thrust washer and the upper element head, which all remain fixed relative to one another. Below the upper element head and above the lower small thrust washer lies a sandwich of two needle bearing assemblies with the rotating element in the middle. The rotating element is constrained to rotate only relative to the upper element head in the yaw axis by this arrangement, which additionally prevents translation up and down. The spacer acts to prevent relative translation in both the front/back direction and the left/right direction. The end result is a one degree of freedom connection that can resist high roll and pitch forces without binding. FIG. 27 shows a cross-section of the components of the release element of FIG. 26 as assembled. These elements include upper element head 2720, large thrust roller assembly 2730, small thrust roller assembly 2740, screw 2750, and spacer 2760.

Referring back to FIG. 2, the helmet pivot mount 203 may be located away from the center of the top of the helmet. For example, the helmet pivot mount may be located at a distance of one to seven or three to five centimeters away from the top of the helmet, wherein the distance is measured along the top of the helmet from the highest most central point. This location has the benefits of reducing the physical size and visually apparent size of the device, particularly from the front view.

The various components of the arm assembly may be formed from any materials that a person of ordinary skill in the art would appreciate as being advantageous in connection with the present invention. For example, the upper member may be in the form of a tube that comprises, consists essentially of or consists of wood, fiber composite material, fiberglass, carbon fiber composite, Kevlar® fiber composite, plastic, fiber reinforced plastic, metal or a metal alloy or a combination thereof. In some embodiments, the upper member is formed from a material or materials that impart sufficient strength and resistance to compression or bending that when the force of the movement of the helmet is exerted, the upper member does not bend. Instead, if a connector between the upper member and lower arms is present, there is movement, such as bending or pivoting, at the connector and/or bending of the right lower arm and the left lower arm and/or pivoting around the pivot mounts located at the shoulder element or elements.

The right lower arm and the left lower arm may, for example, be, comprise, consist essentially of or consist of composite materials such as wood, plywood, Kevlar®, carbon fiber, and combinations thereof. They can also be, comprise, consist essentially of or consist of plastic or metal, or other spring-like material or a combination thereof. In one embodiment, the lower arms comprise, consist essentially of or consist of fiberglass.

As noted above, the above-described designs facilitate the transfer of load from a user's head and neck to the user's torso. This may be facilitated by having the left shoulder pivot mount and the right shoulder pivot mount located in a vertical plane with the center of gravity of the helmet when the helmet is level. The shoulder pivot mounts are examples of receiving apparatuses.

Figure 6:
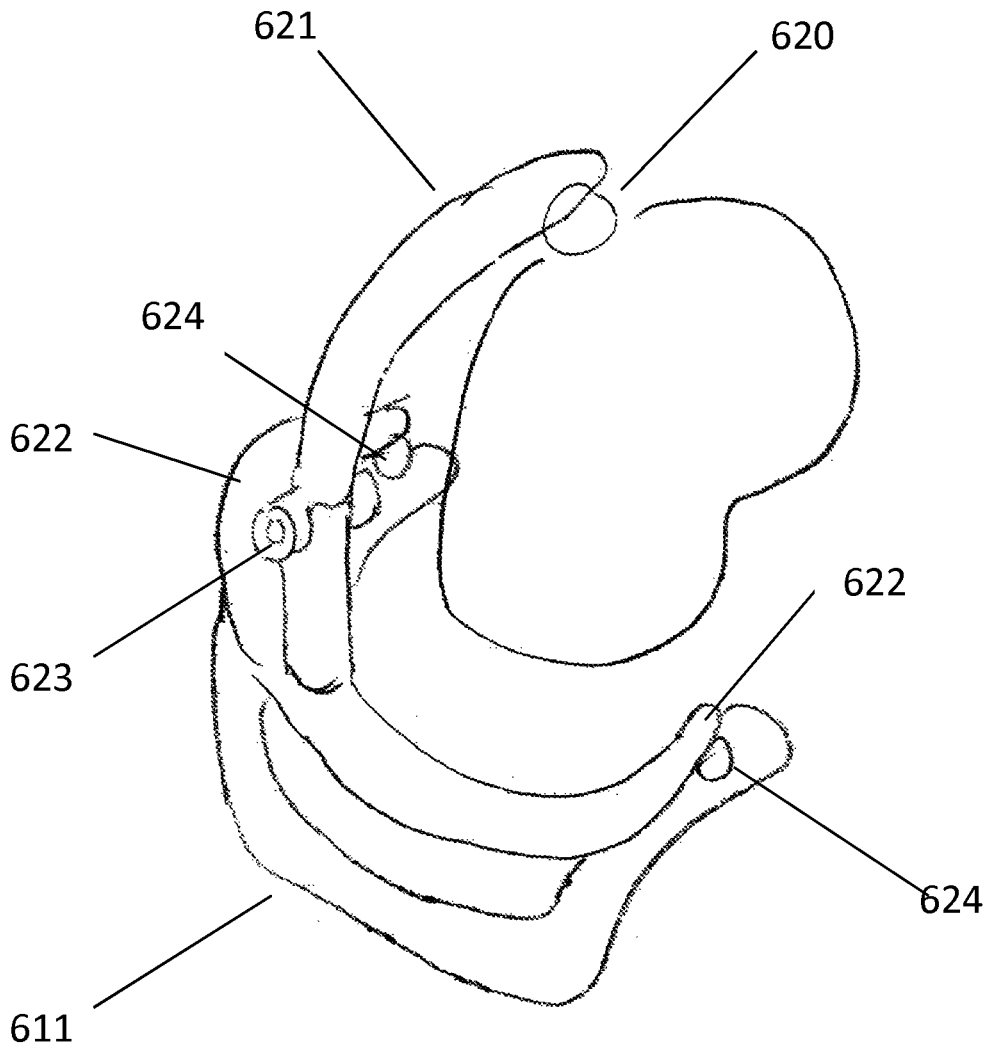
FIG. 6 is a representation of another device of the present invention. In this embodiment, the device is configured as an inverted T with a hinged upper member.

FIG. 6 is a representation of another embodiment of the present invention. In this embodiment, the top connection at the helmet pivot mount comprises a ball joint 620, but could also be a pin joint with only yaw freedom of movement, or a pair of pin joints, which would allow only yaw and roll movement. The upper member 621 of the arm assembly in this embodiment is a flex arm, connected to U shaped rigid arms 622 by a pin joint 623. The rigid arms connect to a shoulder bracket 611 with two shoulder ball joints 624. In this embodiment the upper member is less rigid than in the previous embodiment, and instead of arms that are flexible, the lower members 622 are rigid. A further variation on this is that the upper member 621 is rigid and the lower members 622 are flexible instead of as described above.

Figure 7:
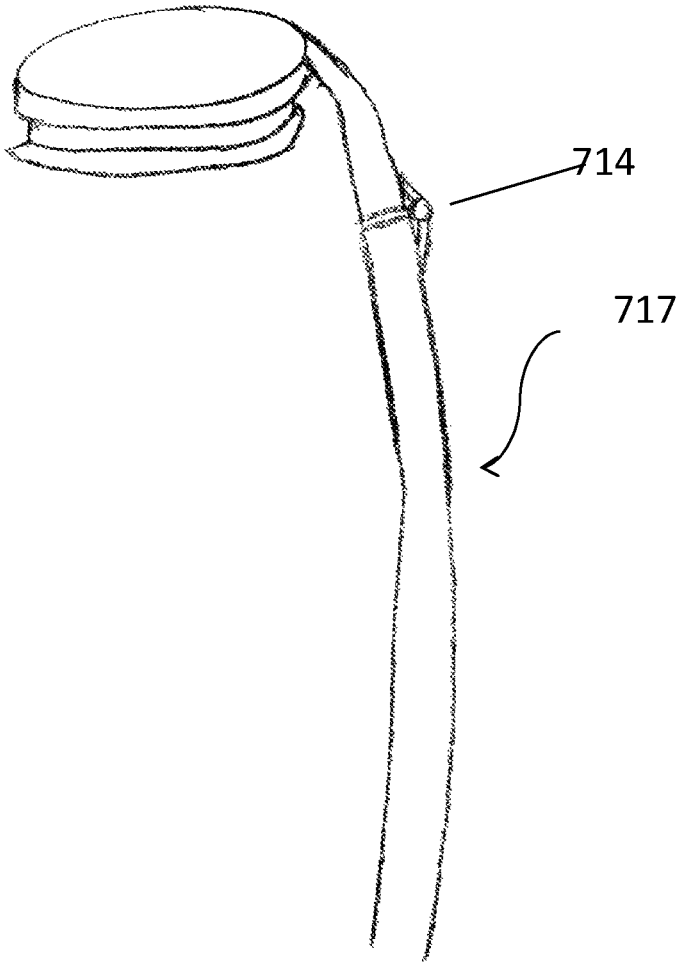
FIG. 7 is a representation of the upper portion of an arm assembly of an embodiment of the present invention in which the arm has a hinge to allow one's head to pitch up.
Figure 8:
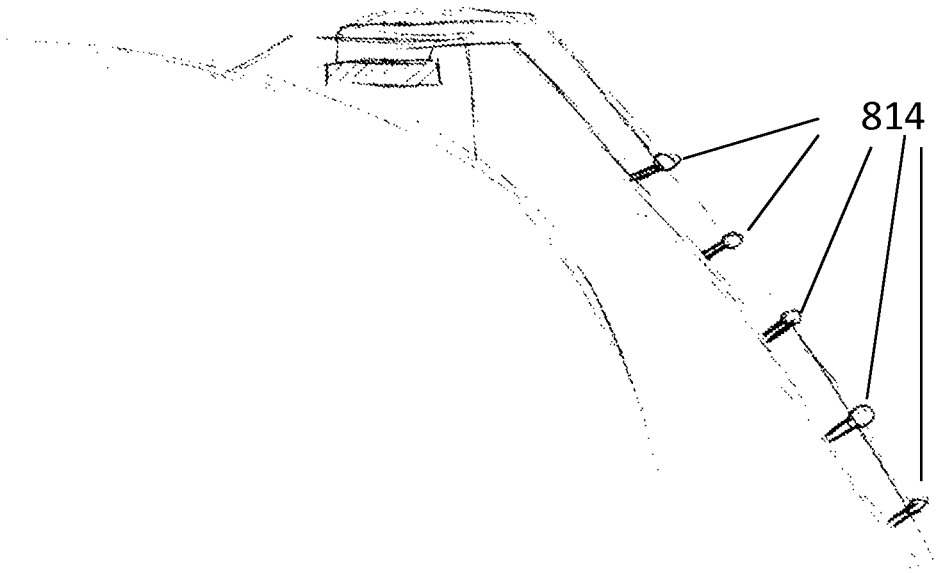
FIG. 8 is a representation of another embodiment of the upper portion of an arm assembly of the present invention, similar to FIG. 7, but with multiple hinges.

FIG. 7 illustrates an optional feature of a hinge 714 in the upper member of the arm assembly 717. This additional feature, when present may allow for easier movement when tilting one's head upwards. FIG. 7 shows the inclusion of a single hinge in the upper member. The hinge allows for improved comfort in certain positions such as prone. The hinge also allows free rotation in the roll axis so that the wearer may look upwards, and is limited in its travel in the downward direction to take the helmet load. In this embodiment, the hinge acts to allow the upper member to rotate clockwise (up) relative to the lower member 717 as shown in FIG. 7, but no rotation is allowed in the down direction as shown in FIG. 7 due to a limit stop, such as the structural elements of the lower and upper sections colliding with each other as shown. There is no need to impose a limit on the movement in the other direction, but due to the structural design in some embodiments, this movement is limited to approximately 90 degrees. In practice, less movement is required by the user. FIG. 8 shows an embodiment of the upper member that contains a plurality of hinges 814 configured to operate in much the same way as the hinge in FIG. 7. When there is a plurality of hinges, they may be evenly spaced apart or unevenly spaced apart.

Figure 10:
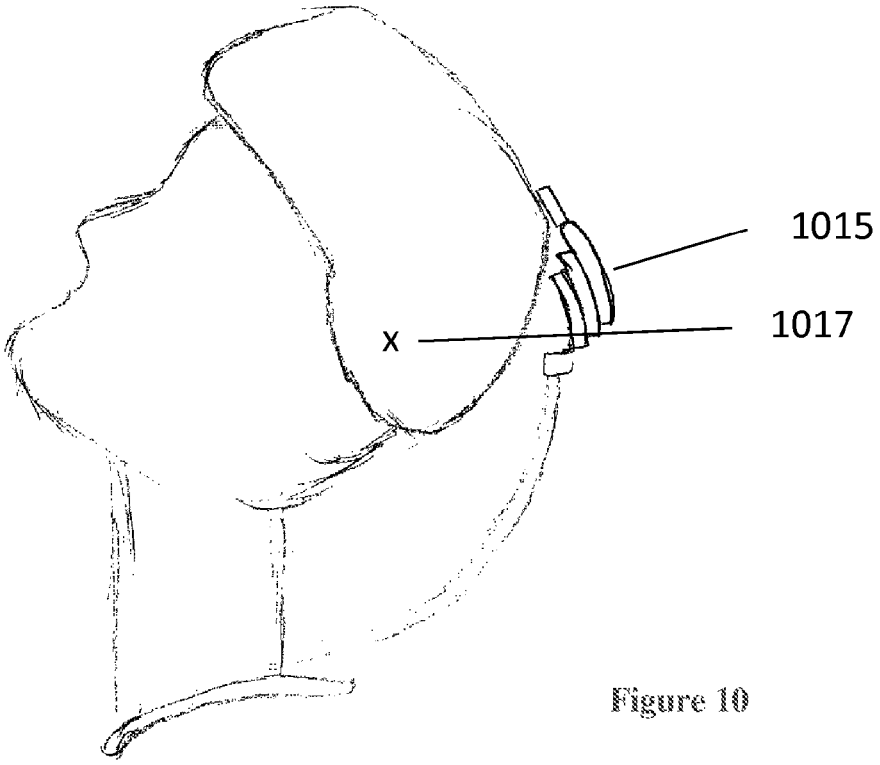
FIG. 10 is a representation of the same embodiment as FIG. 9, but in the fully collapsed position.

In FIG. 9 the upper member has curved overlapping segments 915 to adapt to changing distances between the head and body. The effect of the overlapping elements is to provide movement of the helmet about a virtual pivot axis 917 in order to allow the head to pitch upward without losing load support. FIG. 10 shows the same device as FIG. 9 with the collapsible segments collapsed 1015 and the relative position of the virtual pivot joint 1017. A variation on this embodiment is a version where the elements telescope instead of overlap.

Figure 11:
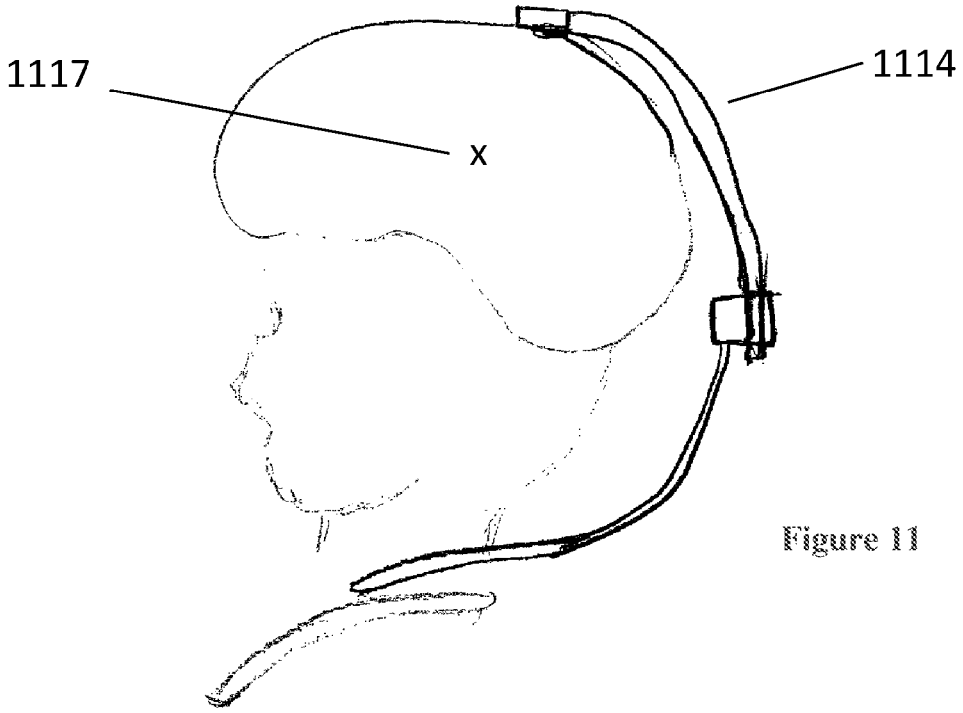
FIG. 11 is a representation of the location of a virtual pivot axis of an embodiment of the present invention.
Figure 12:
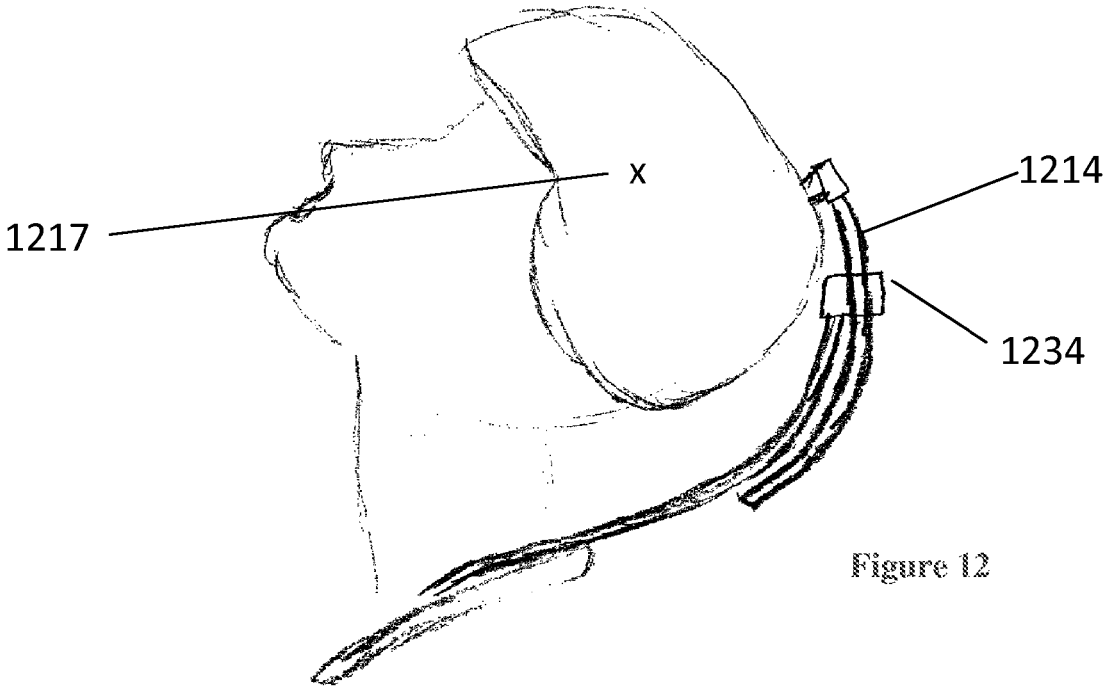
FIG. 12 is a representation of the same device as in FIG. 11, but in the fully articulated position.

In FIGS. 11 and 12, the upper arm portion may have a sliding element 1114 to adapt to changing distances between the head pivot mount and a user's shoulders. The effect of the sliding elements is to provide movement of the helmet about a virtual pivot axis 1117 in order to allow the head to pitch upward without losing load support. Thus, in FIG. 11, the sliding element 1114 is extended and in FIG. 12 the sliding element has slid through the intra-arm assembly connector 1234. For reference, the virtual pivot joints are shown 1117 and 1217.

Another embodiment of the present invention is represented by FIGS. 15-20. This device offsets the weight of head borne equipment and comprises a helmet and an arm assembly. Various features of this embodiment may be further understood first by reference to FIG. 15. The helmet 1590 has a body 1512 that protects a person's head and a helmet pivot mount 1511, which is fixed to the helmet.

The arm assembly 1595 comprises an upper member 1501, wherein the upper member has a first end and a second end. The upper member is associated with the helmet at the first end of the upper member. The upper member comprises an arm roll bearing located inside the upper member at location 1513, a top bearing 1502, and a top bearing holder 1503, wherein the arm roll bearing, the top bearing and the top bearing holder are located at or near the first end. The arm roll bearing connects the bearing holder to the rest of the upper member and allows freedom of roll rotation between those two elements while preventing other movements. There is no limit in this connection on the amount of rotation allowed. The upper member also comprises an arm bearing 1504 and an arm bearing travel stop 1505.

The device also contains a pair of lower flexible arms 1506, only one of which is visible in FIG. 15. These flexible arms are denoted as a left lower flexible arm and a right lower flexible arm. The left lower flexible arm has an upper end and a lower end and the left lower flexible arm is associated with the upper member at the upper end of the left lower flexible arm. There is also a left adapter 1507, a left rod end bearing 1508, a left shoulder mount 1509, and a left shoulder base 1510, wherein the left adapter, the left rod end bearing, the left shoulder mount and the left shoulder base are located at the lower end of the left lower flexible arm. Similarly, the right lower flexible arm has an upper end and a lower end and the right lower flexible arm is associated with the upper member at the upper end of the right lower flexible arm. There is also a right adapter, a right rod end bearing, a right shoulder mount, and a right shoulder base, wherein the right adapter, the right rod end bearing, the right shoulder mount and the right shoulder base are located at the lower end of the right lower flexible arm. The left adapter 1507 is configured with a socket that accepts the end of the flex arm 1506, securing it with a screw through both elements. The opposite end of the adapter is formed as a round quick release pin, also known as a "faspin," which incorporates a spring ball detent near the end of the pin. This pin is inserted into a hole in rod end bearing 1508 that is sized to be a clearance fit on the pin. An internal groove is provided inside this hole in a location that corresponds to the ball detent. These elements combine to create a pin joint connection with only roll rotation freedom. They also provide a quick-release connection because of the ball detent engaging the groove.

In order to assemble the joint, the pin is forced into the hole in the rod end bearing until the ball detent clicks into the internal groove. To disassemble the joint the adapter or flex arm is pulled backward out of the hole in the rod end bearing. The rod end bearing 1508, in addition to having a first hole for the quick release pin, has at its other end a second hole that is perpendicular to the first hole for the purpose of creating another pin joint with the shoulder mount 1509, which has a corresponding hole that passes from right to left through a pair of ears that envelop the second hole in the rod end bearing. A roll pin forms the axle of this joint, and a pair of plastic shoulder bushings are located between each ear and the rod end bearing. This joint provides free rotation in the pitch axis and no other freedom. In some embodiments, the joint allows pitch of approximately 100 degrees forward and back from vertical, for a total angle of approximately 200 degrees.

The shoulder mount 1509 and shoulder base 1510 are also connected by a pin joint. A vertical boss on the bottom of the shoulder mount extends vertically down through a hole in the center of the shoulder base. The end of the boss is provided with a retaining ring groove, and a spiral retaining ring is located in that groove. The outside diameter of the installed ring is bigger than the diameter of the hole in the shoulder base, thereby keeping the two elements assembled.

The shoulder base is provided with tapped holes that can accept screws for firmly mounting it to whatever fixed element on the person is available, e.g., a buckle or bracket on a shoulder strap. This joint allows only yaw rotation and no other freedom of movement. There is no limit to the amount of yaw rotation allowed by this joint. The combination of the three shoulder joints described above creates in effect a ball connection between the flex arm and the shoulder base with three degrees of rotational freedom and zero degrees of translational freedom. It should be noted that while in this embodiment the quick release function is associated with the roll axis connection, in other embodiments it can be at the pitch axis connection, the yaw axis connection, the connection between the shoulder base and to what it mounts. Additionally or alternative, a buckle, strap, or structure that is mounted to the shoulder base can in turn be quick-releasable from to whatever it is connected. For example, it can be a Velcro® latch and hook connection, magnets, quick release pin, or other releasable connection means.

As shown in FIG. 15, the stop element 1505 prevents the arm bearing 1504 from moving further. Consequently, when the helmet wants to pitch down, the system acts like it does not have that bearing. If one adds weight to the front of the helmet, the stop prevents the helmet from dropping down over one's eyes. Even if one doesn't add weight, the stop still helps make the helmet more comfortable in this position and makes it more forgiving of misalignment of the center of gravity. When looking up (pitching the helmet up), any forward weight imbalance is less noticeable because it is masked by the effort of looking up, and also minimized by virtue of the fact that the act of looking up tends to move heavy front devices such as night vision goggles toward the rear and more over the line of support.

Within the scope of this design, element 1501 may have a circular cross section, or a different cross section, e.g., a square, rectangle, oval, etc. Additionally, arm bearing 1504 may be designed such that it is not capable of rotating on the upper member, but it is capable of translating along the length of the upper member. The fact that the arm and arm bearing are curved will serve to resist this movement even for an embodiment with a circular cross section.

By way of a non-limiting example, the bearing may be a plain bearing, for example, made of PTFE, and the arm may be aluminum with a PTFE impregnated hard coat anodized finish. In some embodiments, there is no lubrication.

Optionally, the device may contain recirculating bearing balls in the arm bearing along with seals at each end of the arm bearing to prevent dirt and water infiltration. Alternatively, the device may contain roller bearings to act like wheels along with seals at each end of the arm bearing to prevent the infiltration of dirt or water. A simple cross section shape makes the use of seals more practical, and seals may be used in any embodiment.

The flexible arms 1506, may be any shape that allows sufficient flexibility to be imparted to the device. For example, they may be straight or curved in a way that allows them to be fairly close together and out of the way mostly, but still curve out and around the user's neck to clear it. The radius of this curve depends on the size of the user and his or her clothing and gear, but typically is about half the distance between the shoulder mounts, which may for example, be anywhere from 14 to 28 centimeters apart.

The shoulder mount base may for example, be attached to shoulder arms or the frame of a backpack, the shoulder area of a vest or other garment, or the shoulder areas of a set of body armor, shoulder pads, etc.

Figure 16:
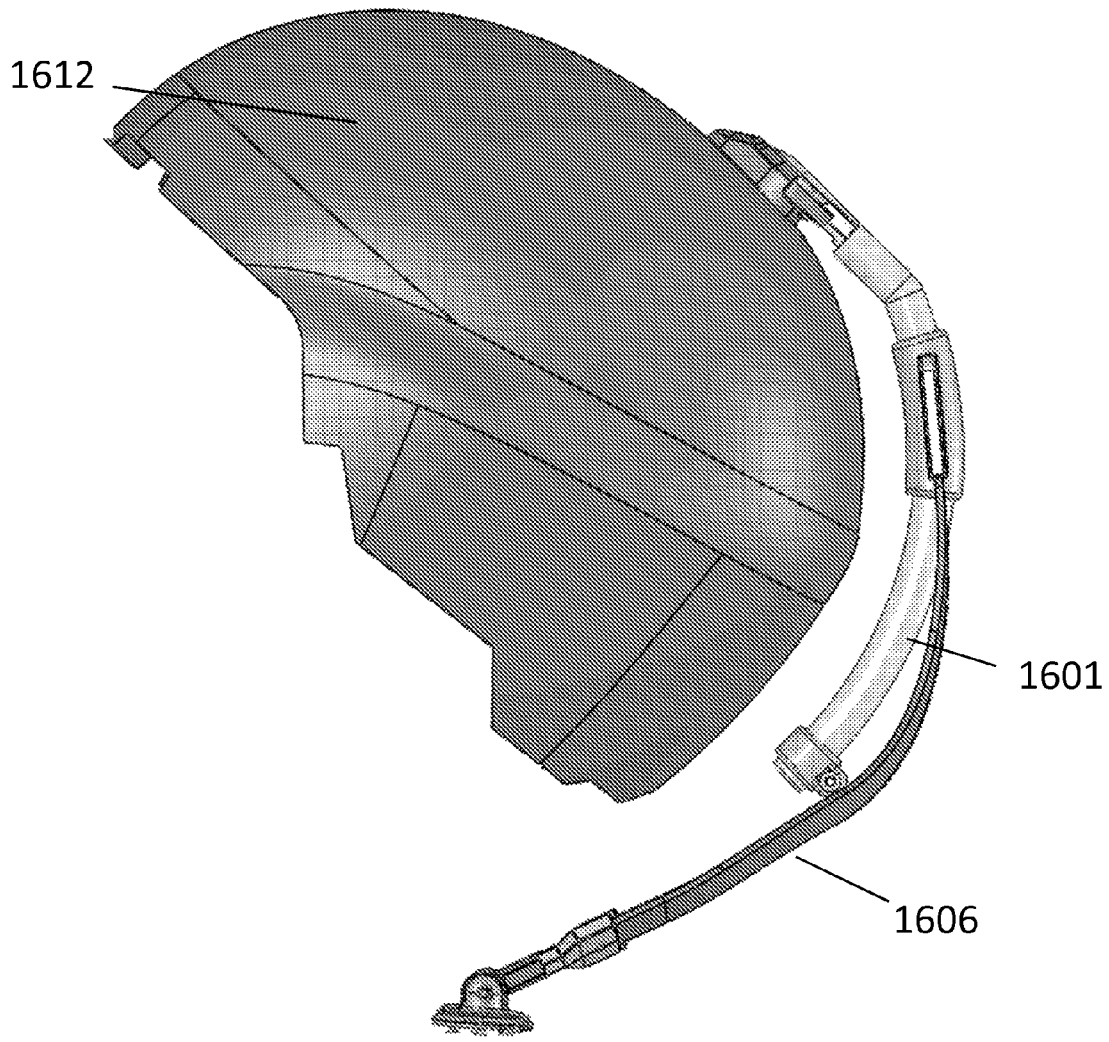
FIG. 16 is a representation of the device of FIG. 15 with the helmet tilted upward.

FIG. 16 illustrates the device of FIG. 15 when a person is looking up when standing, or looking forward when prone. As shown, the upper member 1601 has moved relative to the flex arm 1606. In addition, helmet body 1612 and the rod end bearing can tilt back. At the same time, the flex arms can flex, all to account for the actual head movement not exactly tracking the arm bearing movement.

Many embodiments of the present invention are designed to introduce sufficient flexibility such that the device is not a rigidly pivoting device and thus is more consistent with the fact that the natural movements of a person's head and shoulders are very complex due to the complicated movements of the upper spine, neck joint, and shoulder joints. Additionally, as persons of ordinary skill in the art are aware, natural movements are restricted by bones, muscles, and connecting tissue, which are all located inside the body. By contrast, the load offsetting device must reside outside the body. In order to permit functionality of the load offsetting device while keeping it external to the human body, there can, in some embodiments, be a curved bearing (1501 in FIG. 15), which places the pivot location inside the head even though the rigid elements creating this pivot are located outside the head, or using a pair of shoulder mounts on either side of the neck, which together emulate a hinge joint at the base of the neck. Thus, instead of exactly mechanically duplicating these biomechanics, the various devices of the present invention get somewhat close with the rigid connections, and rely on the fact that the flex arms have the ability to provide the remaining freedom of movement required to avoid introducing adverse forces or limits on movement that would work against a user of this device when he or she moves his or her head around.

Figure 17:
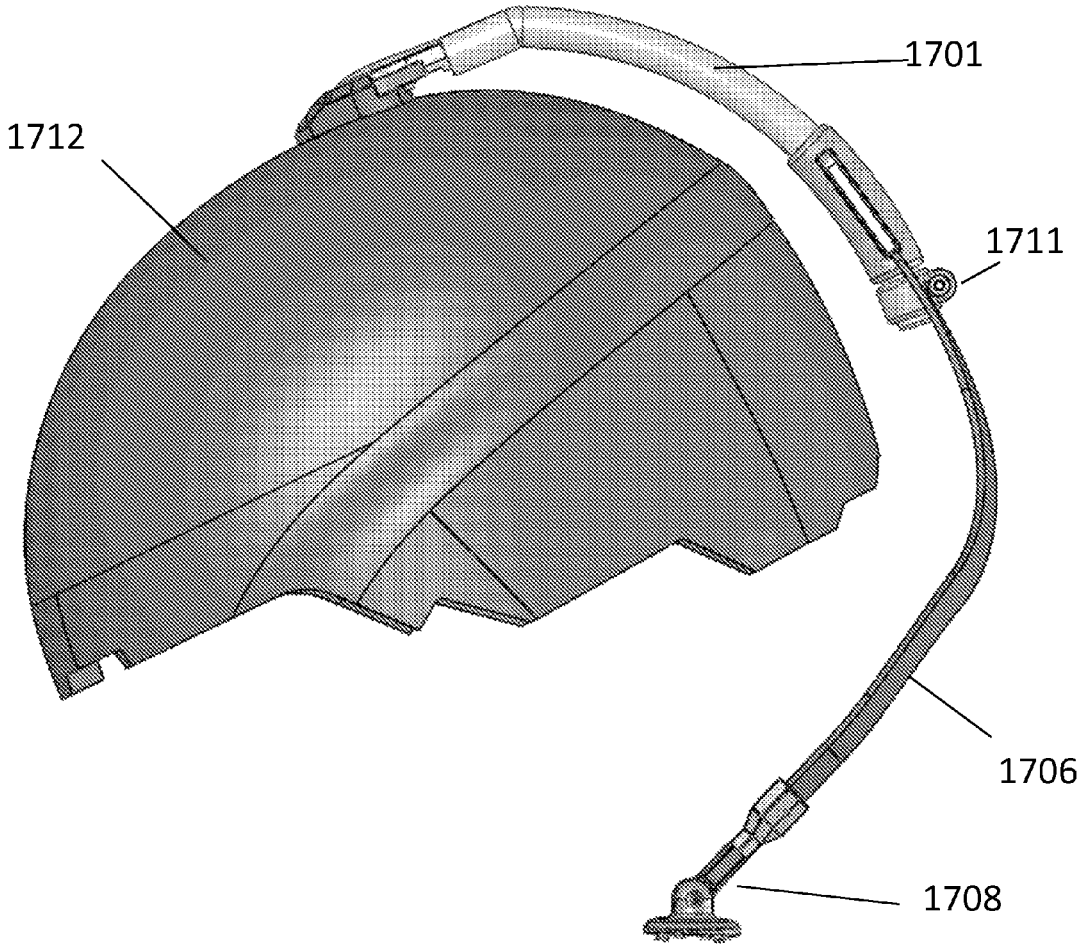
FIG. 17 is a representation of the device of FIG. 15 with the helmet tilted downward.

FIG. 17 illustrates the device of FIG. 15 when a person is looking down with, for illustrative purposes, the person not shown. The stop 1711 prevents the upper arm 1701 from moving. The rod end 1708 rotates and the flex arms flex more to allow this movement. The additional flexing of the flex arms 1706 helps to support the helmet body 1712 in this scenario, and it helps to offset the additional perceived load that one gets as the helmet weight starts to bear down more toward one's forehead as opposed to down through one's neck.

Figure 18:
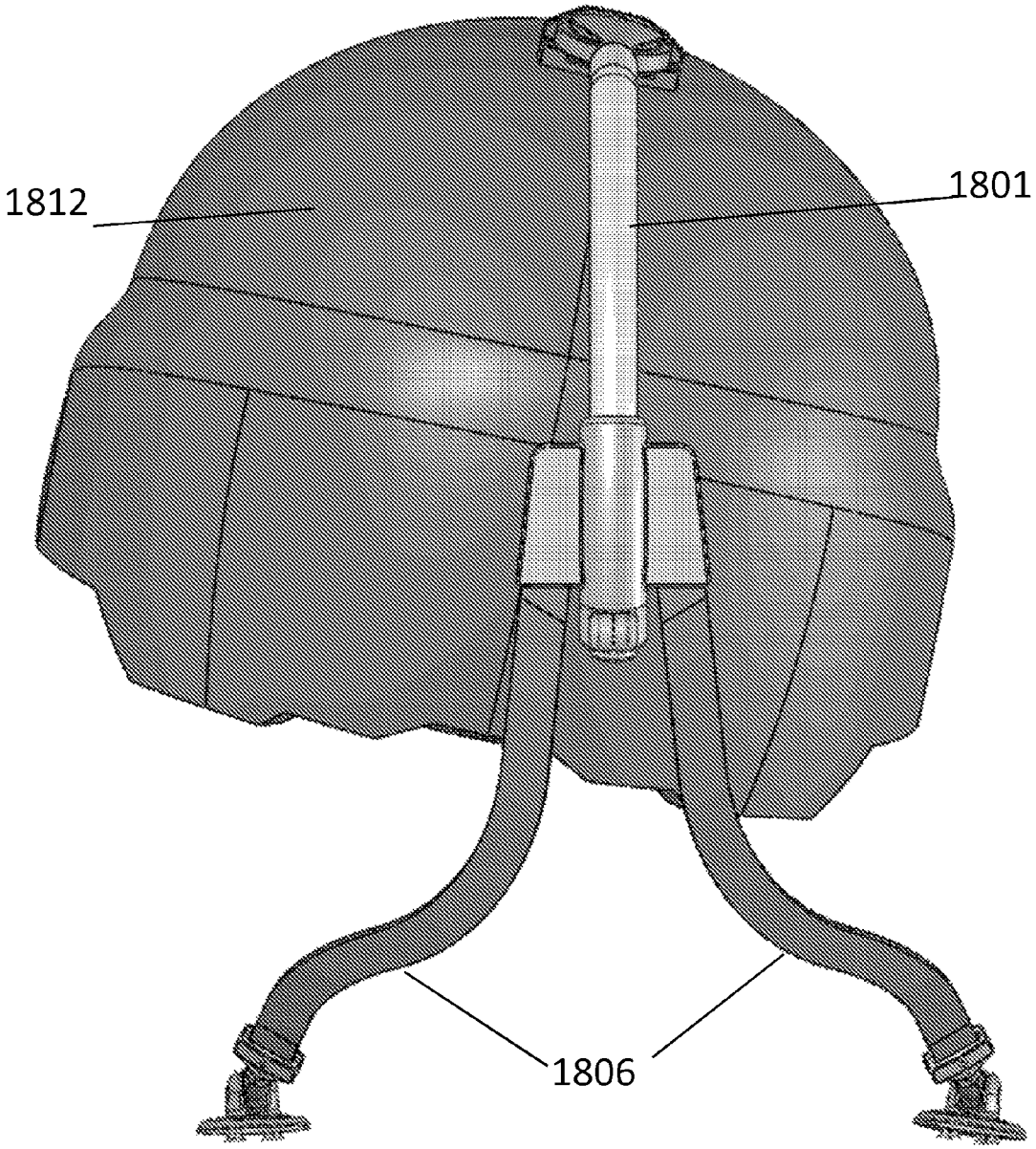
FIG. 18 is a representation of the device of FIG. 15 from the rear.

FIG. 18 illustrates the device of FIG. 15 when a person rolls his or her head ear to shoulder. In this circumstance, there is freedom for the helmet body 1812 to roll relative to the arm because of the configuration of the bearing between the arm and the top bearing holder that allows for pivoting. In many uses, the two flex arms 1806 flex differently and allow the upper member 1801 to tilt with the helmet as well. For example, the flex arm to the right in FIG. 18 bends more to allow a shorter distance between the helmet receiver and the right shoulder mount, and the flex arm on the left relaxes somewhat to allow for a greater distance between the helmet receiver and the left shoulder mount.

Figure 19:
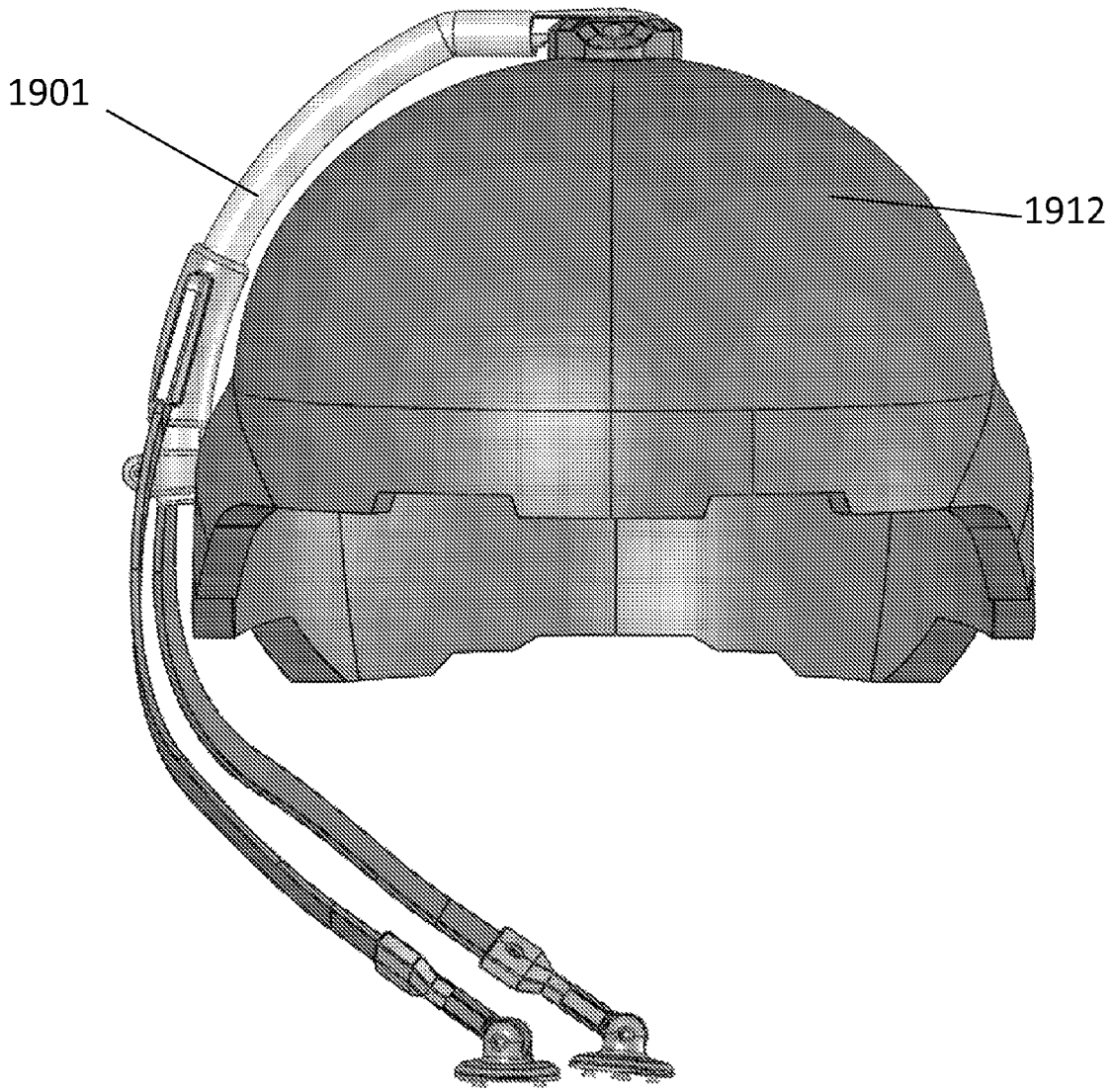
FIG. 19 is a representation of the device of FIG. 15 from another perspective.

FIG. 19 illustrates the device of FIG. 15 as worn by a user whose body is facing to the right with his or her head turned to look over his or her right shoulder at the observer. The center of the arc of the arm lies in the midline symmetry plane of the helmet body 1812 so the support vector for the helmet provided by the arm will be pushing up through the center of the helmet. If it were off to one side the user would feel the helmet wanting to tip to the left or right on their head. The upper member 1901 forms the arc that has an arc center within the helmet.

Figure 20:
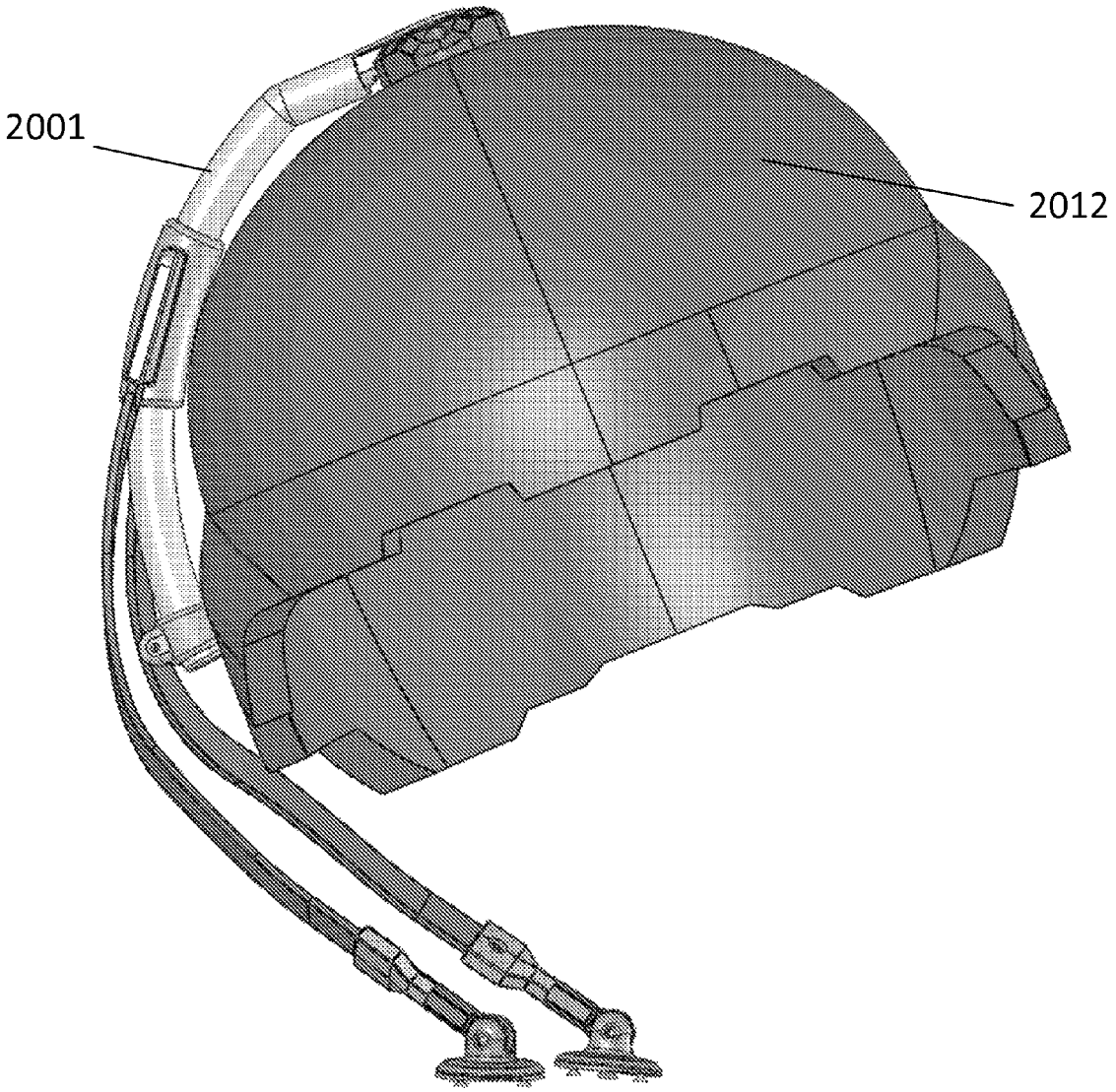
FIG. 20 is a representation of the device of FIG. 19 wherein the helmet is tilted.

FIG. 20 illustrates the device of FIG. 15 when in a position similar to that of FIG. 19, but with the helmet body 2012 tilted. The upper member 2001 can allow for this (and more complex) movement. Again, as the head is moved through its range of movement, the flex arms also move to accommodate the movement, but the key to free-feeling movement is in the rotating joints and the curved arm joint (the connection between 1501 and 1504 in FIG. 15), which do not provide a spring like force to the user, whereas a movement that requires further compression of a flex arm resists the user's movement with the increased spring force of that arm.

Figure 21:
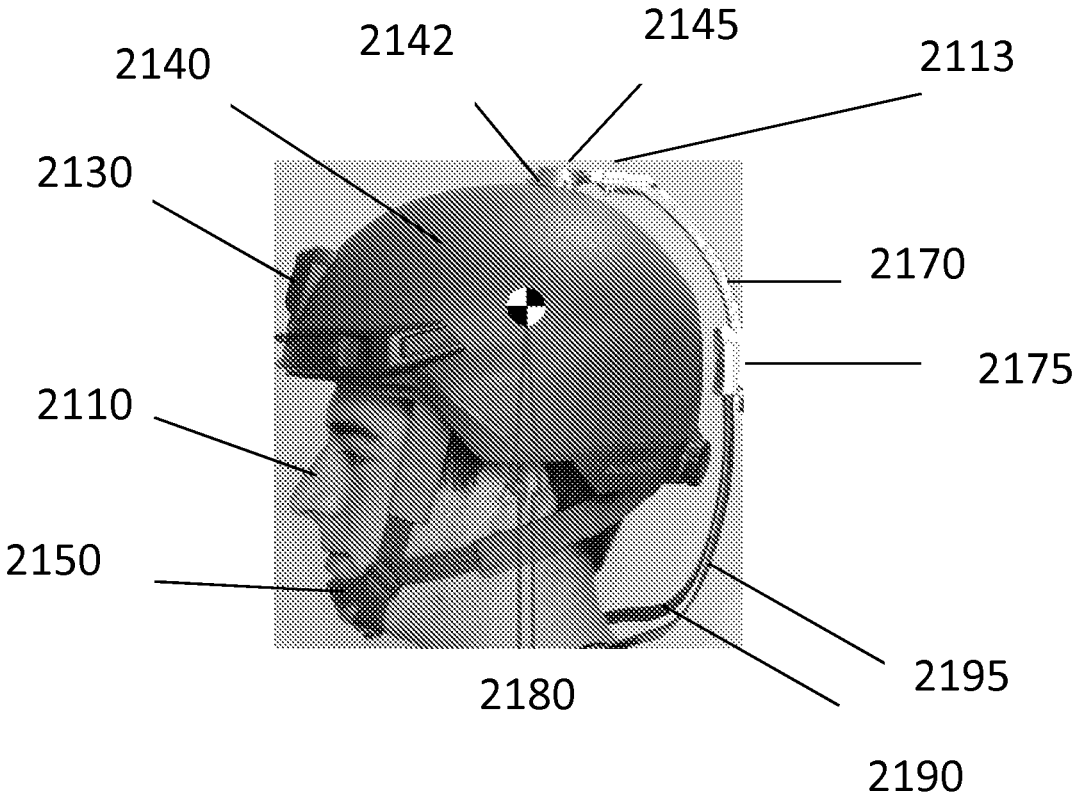
FIG. 21 is a representation of a person wearing a device of the present invention.

Various embodiments of the present invention may be further understood by reference to FIG. 21. As shown in that figure, a user 2110 is wearing a device that comprises a helmet that has a helmet body 2140 and a helmet pivot mount 2142; and an arm assembly that contains an upper member 2170, a pivoting apparatus 2145 for connection to the helmet pivot mount, a left lower arm 2195, a right lower arm, 2190, and an intra-assembly arm connector 2175 and roll bearing 2113. Additionally, for reference, the location of the center of gravity is identified 2180. The figure also provides an example of a chin strap 2150 that forms connections with the helmet in front of the ears and at the back of the head. Finally, the figure illustrates the location for an attachment element for an auxiliary device 2130.

Figure 28:
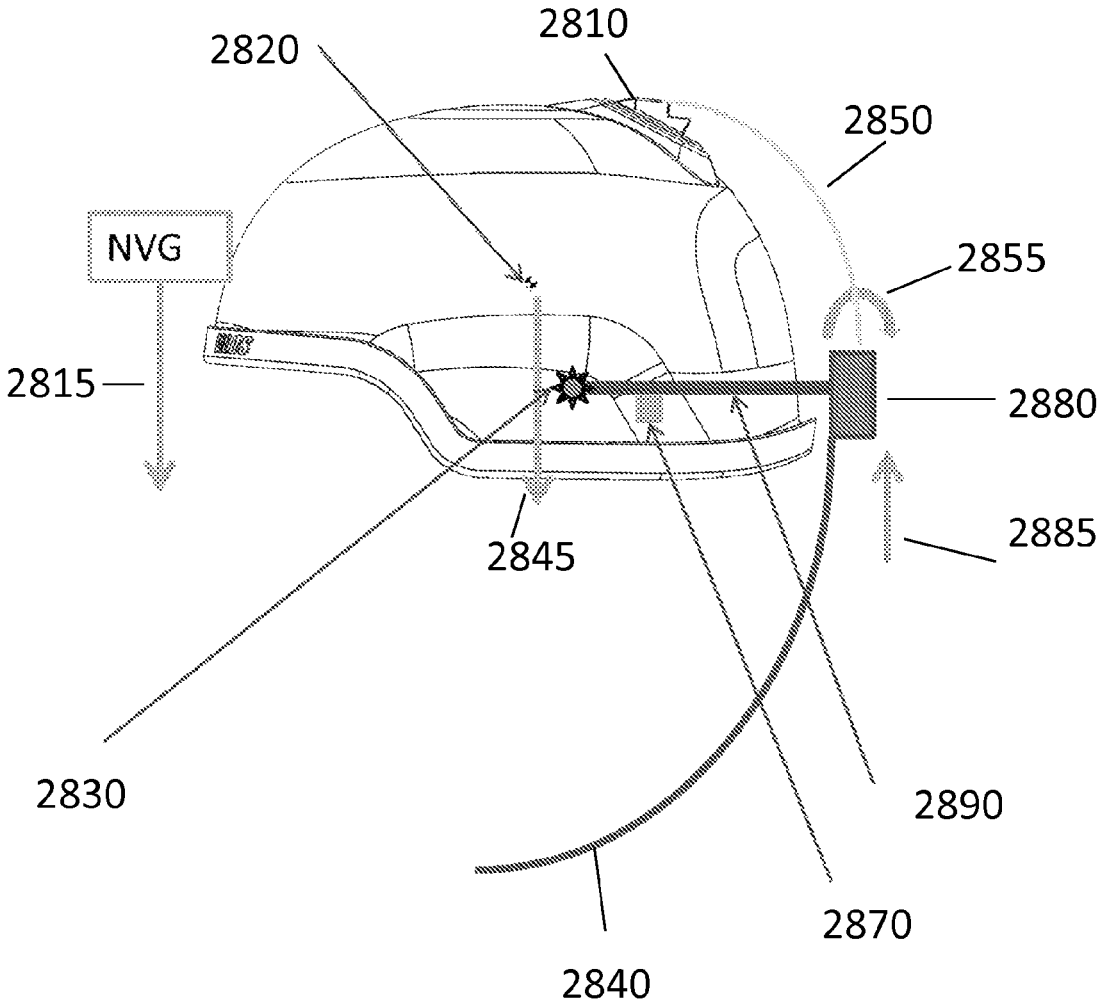
FIG. 28 is a representation of various forces and virtual elements of an embodiment of the present invention.

Various forces and virtual elements of the present invention may be appreciated by reference to FIG. 28. As this figure illustrates, the moment from the spring arm 2840 through the virtual moment arm 2890 to the virtual pivot 2830 facilitates maintaining a generally upward force direction and consistent offset performance. In FIG. 28, the helmet is connected to the rigid upper member of the arm assembly 2850 at a first end of the upper member through a helmet pivot mount 2810. At the second end of the arm assembly is the intra-arm assembly connector 2880. The intra-arm assembly connector is in the form of a follower bearing that travels in one degree of freedom along the upper member 2850, which is in the form of an arc having a center at virtual pivot location 2830. As a result, any forces or moments (in the plane of FIG. 28) transmitted from the intra-arm connector 2880 to the upper member 2850 will act through this virtual pivot. The term "virtual" is used to refer to a location that itself does not have a specified structure at its location and instead is defined by one or more physical structures that are located elsewhere in the device. In addition, a stop 2870 is represented, which prevents the helmet from rotating any further counterclockwise relative to the connector 2880 as shown in FIG. 28. This stop 2870 is a schematic representation of the function of the actual stop 1505 depicted in FIG. 15. The helmet is free to rotate clockwise relative to the connector 2880 from the position depicted in FIG. 28.

Also shown connected to intra-arm assembly connector is a flexible lower arm 2840. A constant force (represented by an arrow) is gravity acting on the helmet 2845. This force is present regardless of whether the user moves his or her head. Another force (represented by an arrow) is gravity acting on any auxiliary device such as night vision goggles (NVG) 2815. In FIG. 28, the flexible lower arm 2840 is shown flexed from its unstressed flat free state into a curved shape and thereby exerts an upward force 2885 and a moment 2885 on the intra-arm assembly connector 2880. The force 2885 acts in a direction that is the opposite to the force of gravity on the helmet and the NVG and thereby counterbalances some or all of this weight. However, this force 2885 in combination with the forces due to gravity (2845 and 2815) will combine to create a counterclockwise moment on connector 2880 because the downward forces are laterally displaced from the upward force located at the virtual pivot 2830. In addition, to the extent that the sum of the forces due to gravity acting on the helmet and NVG act forward of pivot 2830, an additional counterclockwise moment will be created when the stop 2870 is preventing counterclockwise rotation of the helmet relative to the connector 2880. These two counterclockwise moments are counteracted by the clockwise moment 2855, which the flex arm 2840 exerts on the connector 2880. The combination of moment 2855 and force 2885 can alternatively and equivalently be represented by a larger upward force of the arm assembly acting on the helmet though the virtual pivot 2830, and a smaller downward force of the virtual moment arm 2890 acting on the stop 2870. Finally, as this figure illustrates, the helmet's center of gravity 2820 is distinct from the virtual pivot point, and located both horizontally above and forward of the virtual pivot point 2830 when the helmet is in its resting position.

Figure 29:
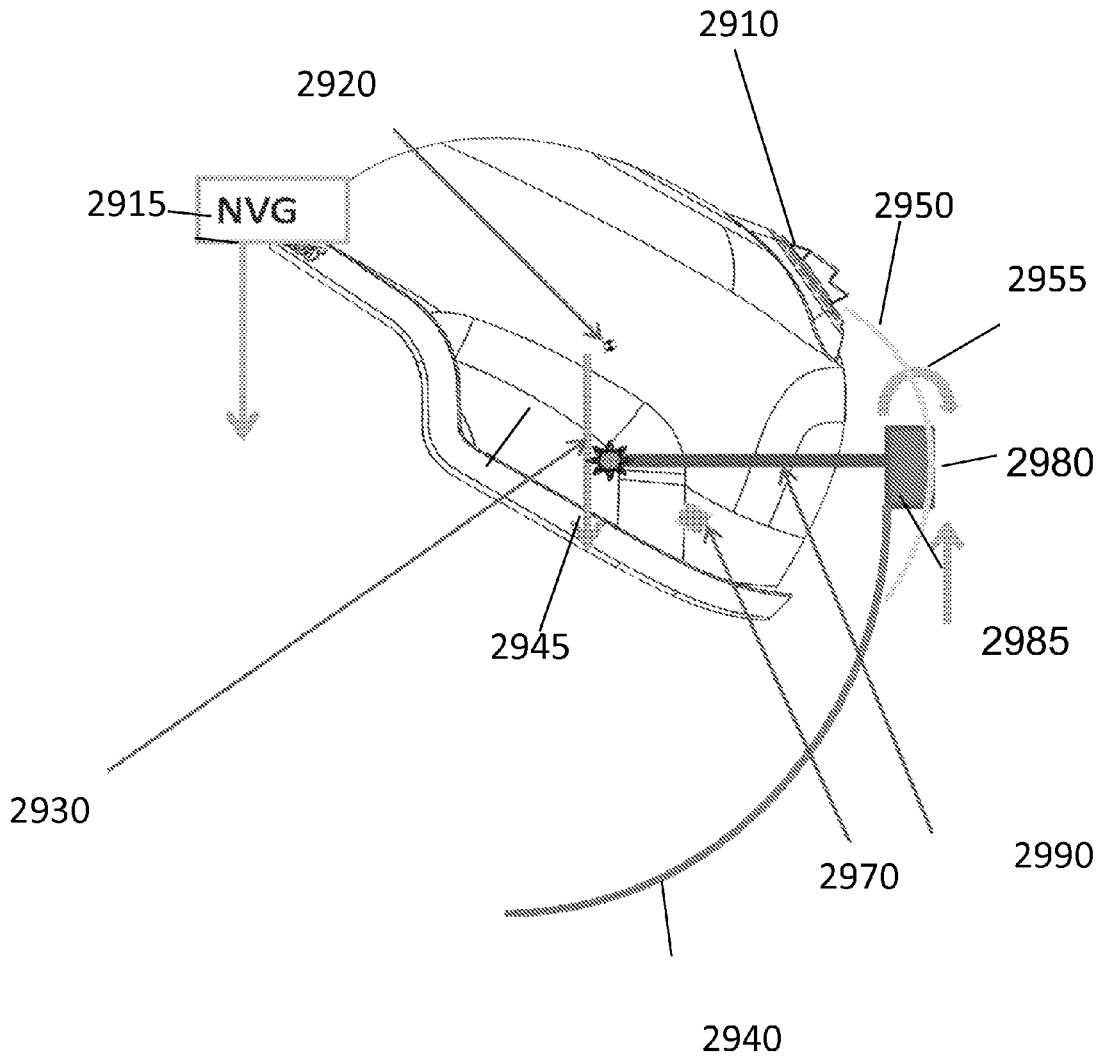
FIG. 29 illustrates the device of FIG. 28 when a helmet is tilted upward.

FIG. 29 illustrates the device of FIG. 28 when a user's head is tilted upward. For illustrative purposes, the wearer and any shoulder elements are omitted in each of these figures. In FIG. 29, the force of gravity 2945 on the helmet and the force on the NVG 2915 are exerted downward. The virtual pivot point 2930 (the eight pointed star in the figure) remains in the same location. The stop 2970 has no function in FIG. 29 because it serves only to limit counterclockwise rotation of the helmet, and FIG. 29 depicts a clockwise rotation of the helmet. However, the center of gravity 2920 has moved to the right in FIG. 29 as compared to FIG. 28 when compared with the center of the arc 2930. This has the effect of reducing, eliminating, or even reversing the moment about pivot 2930 induced by the gravity forces acting on the helmet and NVG, and thereby making the stop 2970 less necessary. The center of gravity and the center of the arc are shown on the surface of the helmet. This is done for illustration purposes. Because the helmet is a three-dimensional object, persons of ordinary skill in the art will recognize that each of these locations is in the interior space, i.e., when in use would be located within the wearer's head.

Thus, as the helmet of FIG. 29 tilts upward in the front, the helmet pivot mount 2910 tilts backward pushing the upper member 2950 partially through the intra-arm assembly connector 2980. The lower arm(s) 2940 will transfer weight to the person's shoulders, body or torso (not shown). The force from the spring arm 2985 will be exerted, as will the moment from the spring arm 2955 through the virtual moment arm 2990. The virtual moment arm 2990 that is created by the upper member arc 2950 remains the same, extending form the virtual pivot point 2930 to the connector 2980. Thus, connector 2980 accepts forces and moments from the flex arm and delivers forces and moments to the helmet through the arc of the upper arm, which allows the virtual pivot to exist.

Figure 30:
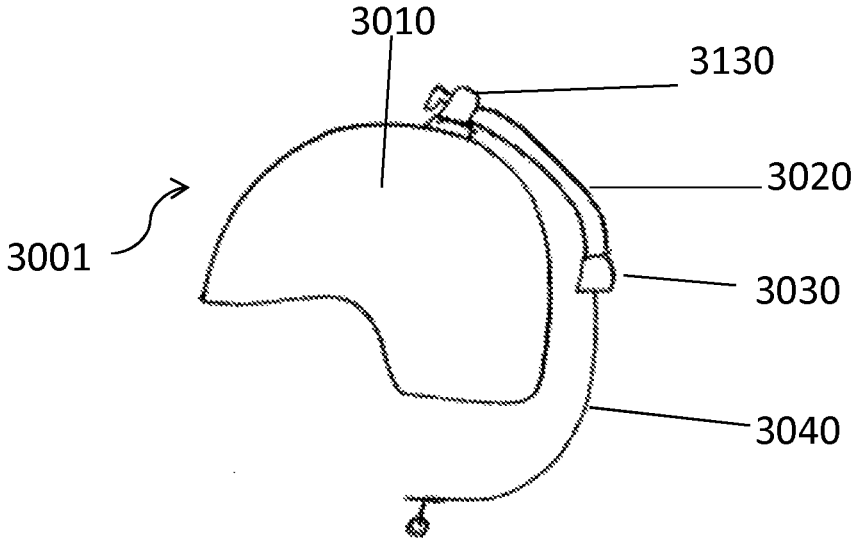
FIG. 30 illustrates a device in which a curved bearing operates at the helmet.
Figure 31:
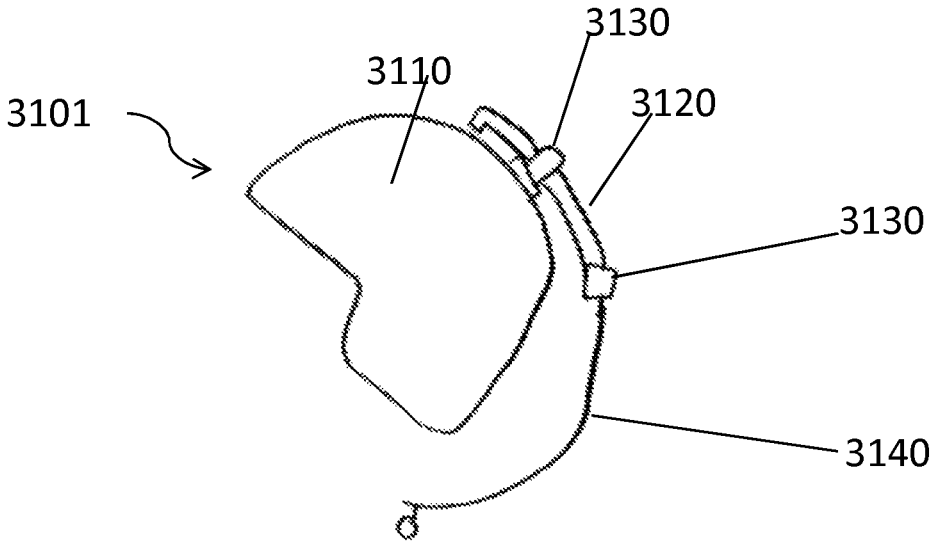
FIG. 31 is the same device as shown in FIG. 30 in which the helmet is tilted upward.

Another embodiment of the present invention is shown in FIG. 30 and FIG. 31. In FIG. 30, the device 3001 contains a helmet 3010, a helmet pivot mount 3030, an upper arm 3020, an intra-arm assembly connector 3030, and two lower arms, only one of which is shown 3040. As shown in that figure, the helmet is situated as if a person who were wearing it were looking straight ahead. Accordingly, essentially all of the upper member 3020 it located between the helmet pivot mount 3130 and the intra-arm assembly connector 3030. In FIG. 31, the same device 3101 is shown, with its helmet 3110, helmet pivot mount 3110, upper arm 3120, intra-arm assembly connector and 3130, and one of two lower arms 3140. However, in contrast to FIG. 30, the helmet 3110 is oriented in a position that simulates a wearer looking upward. Because the front of the helmet is titled upward, the upper member slides through an element at the helmet pivot mount 3130 and the amount of the upper member between that element and the intra-arm assembly connector decreases.

According to another embodiment, the present invention provides an arc bearing, wherein the arc bearing creates a virtual pivot within the head of a person who wears a head borne device such as a helmet or other device that facilitates traction and/or weight distribution. By creating a virtual pivot within the head of a person who wears the device, in some embodiments the device is capable of stabilizing a person's head and/or neck through traction and/or redistribution of weight. The arc bearing of this embodiment, may, by way of non-limiting examples, be solid, hollow or a combination thereof. Additionally, it may have a regular or irregular curvature that creates a virtual pivot within a person's head. As persons of ordinary skill will recognize the location of the virtual pivot is not dependent on the device being located on a person's head. Thus, when the device is not being worn, the virtual pivot location will be within the space that corresponds to the location of the person's head.

This embodiment may be used in conjunction with other embodiments of the present invention. For example, the arc bearing may be connected directly or indirectly to a helmet. Additionally or alternatively, the arc bearing may comprise a spring support. Further, in some embodiments, the device further comprises one or more of a helmet pivot mount. a left lower arm and a right lower arm, wherein the left lower arm and the right lower arm are connected directly or indirectly to the arc bearing and a right shoulder connector, wherein the right shoulder connector is associated with the right lower arm, and a left shoulder connector, wherein the left shoulder connector is associated with the left lower arm.

According to another embodiment, the present invention provides a device for support. This device comprises a curved element and a bearing element. The curved element comprises, consists essentially or consists of a curve region having a shape that is partially or completely in the form of an arc, wherein the radius of curvature at each point along the curve places the center of the arc within a space that corresponds to a head of a person. The bearing element is free to move to different points on the curve while maintaining a constant angle relative to a line tangent to the curve at each point along the curve.

The curved element may be coupled to the head of a person. Coupling may be through direct connection or through one or more other structures or devices, e.g., a helmet. Thus, the curved element may be coupled directly or indirectly to one or both of a helmet and a user's head. Similarly, but independently, the bearing element may be coupled directly or indirectly to one or both of the head of a person and a helmet.

The devices of this embodiment may contain one or both of a pivot mount, and one or more lower arms, wherein the one or more lower arms are coupled to the bearing element. Alternatively or additionally, the lower arm or lower arms may be coupled to the curved element. Further, the device may contain a torso connector, wherein the torso connector is associated with a lower arm. If there are a plurality of lower arms, and a plurality of torso connectors, each torso connector may be associated with a lower arm. A torso connector is a structure such as a mount and/or reciprocal feature that permits the device to be associated with the torso of a person, including but not limited to at the person's shoulders or elsewhere on the torso.

Figure 32:
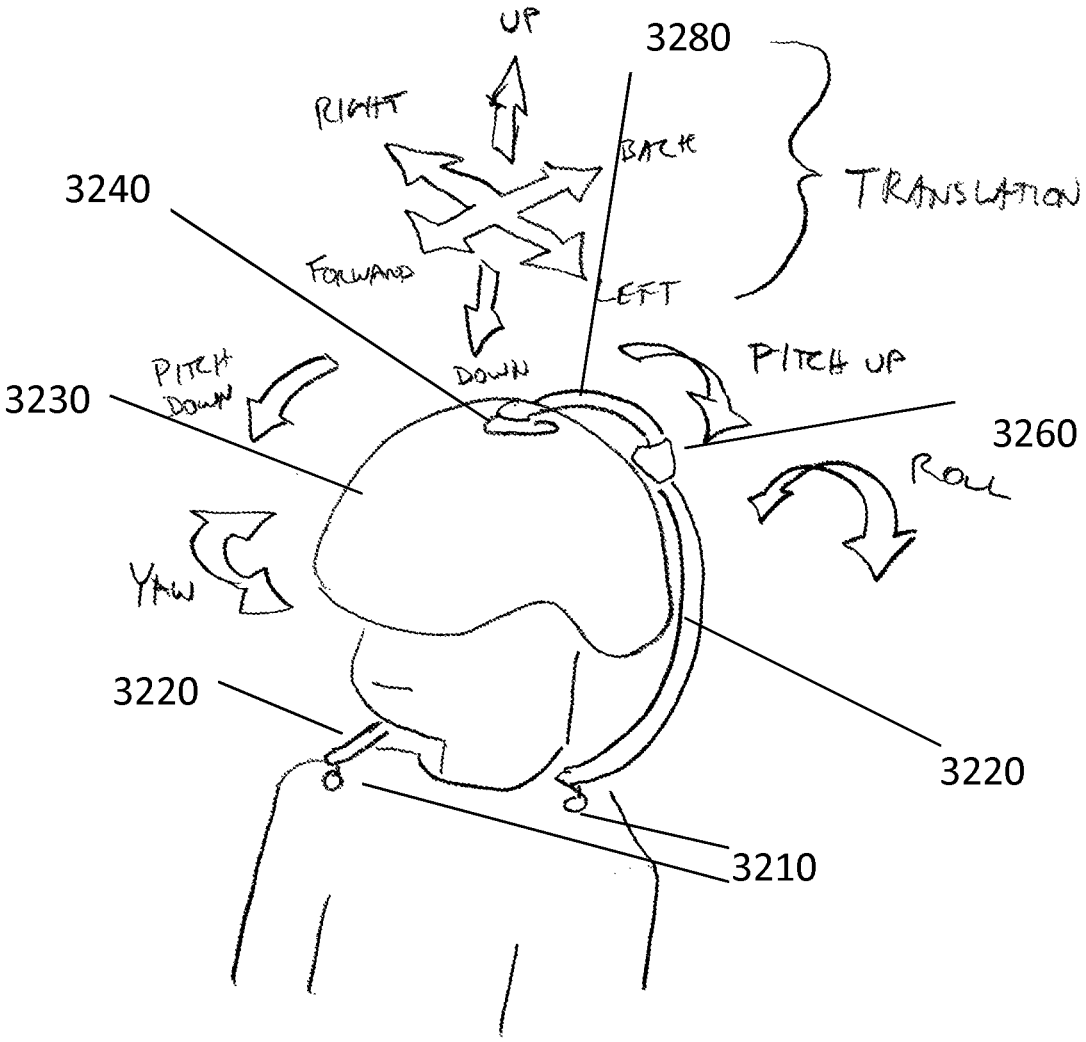
FIG. 32 is a representation of the movement of a device of the present invention with respect to yaw, pitch, roll and translation.

Various embodiments of the present invention are described in connection with the parameters of yaw, pitch and roll. FIG. 32 illustrates a person wearing a device of the present invention and how each of these features as well as translation can be impacted by the present invention. As shown in the figure, on a person's head sits a helmet 3230 that possesses a helmet pivot mount 3240. The helmet pivot mount is connected to an upper member 3280, which in turn is connected to an intra-arm assembly connector 3260. The intra-arm assembly connector is connected to right and left lower arms 3220, each of which is connected to a shoulder pivot mount 3210.

The labeled arrows show the six possible degrees of freedom of an object: three translational and three rotational. Each degree of freedom has two possible directions. As shown in the upper portion of the figure, the three degrees of freedom of translation refer to linear movement that can occur in three dimensions, up/down, right/left, and forward/back. The other arrows refer to the three degrees of rotational freedom: pitch up/pitch down, roll left/roll right, and yaw left/yaw right. Various constructions and connections between elements of the present invention limit translation and or rotation in one or more of these directions between elements of the device apart from the person who wears the device.

According to another embodiment, the present invention provides a device for offsetting neck borne weight comprising a head member and an arm assembly. The head member comprises a head association structure, and a pivot mount. The head association structure may be helmet or helmet body or other device or set of devices allow association with a user's head to be maintained, e.g., a visor or straps, which may be particularly advantageous in medical settings.

The arm assembly comprises an upper member, wherein the upper member is associated with the pivot mount, and at least one lower member, e.g., one, two, three or more lower members, wherein each lower member has an upper end and a lower end. When there is one lower member, it is associated with the upper member at the upper end of the lower member. When there is a plurality of lower members, all or fewer than all of them may be associated with the upper member as the upper end of the lower member.

The upper member may be associated with the pivot mount through a connection element that allows one degree of rotational freedom about the yaw axis. Additionally or alternatively, the upper member may be associated with the pivot mount through a connection element that allows a first degree of rotational freedom about a yaw axis, and a second degree of rotational freedom about a roll axis. The connection elements may, for example, be in the form of joints described elsewhere in this specification.

In some embodiments, each lower member is flexible. Additionally, the lower end of the each lower member may be associated with a user's torso. When the lower member is associated with the user's torso, it may, for example, be through a connection element that allows three rotational degrees of freedom. When there is a plurality of lower members, each of them may be associated with a user's torso or fewer than all of them, may be associated with a user's torso, e.g., only 1 of 2 or 1 of 3 or 2 of 3. When a plurality of lower members are present, and each is associated with the torso, they may be associated at the same or different points on the torso, e.g., opposite shoulders or higher and lower on the torso.

The shape of the upper member may be any shape described in connection with other embodiments of the present invention. For example, the entire a section of the upper member or a portion thereof may be in the form of a curve, with the curve having a shape such that the radius of curvature at each point along the curve places the center of the arc inside a user's skull. In some embodiments, the upper end of one or more lower members that are present is associated with the curve of the upper member with a one degree of freedom sliding connection that has the property of maintaining the upper end of the lower member at a substantially constant angle relative to a line tangent to the curve at each point along said curve. The curve may, for example, be in the form of an arc.

In some embodiments, the connection between the upper end the lower member or members and the upper member comprises an intra-arm connecting member. By way of a non-limiting example, the intra-arm connecting member may comprise a plain bearing or it may comprise two or more roller bearings or a recirculating ball bearing, or a combination thereof.

With respect to the intra-arm connecting member, in some embodiments, it envelops the upper member. Additionally or alternatively, it may comprise at least one sealing structure.

The upper arm may comprise a stop that limits the amplitude of movement in one direction of a lower member or a plurality of lower members relative to the upper member. This stop may, for example, be movable and can be fixed in various locations on the upper member.

It will thus be seen that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that this description is intended to cover all of the generic and specific features of the invention herein described and all statements of the scope of the invention which, as a matter of language, might be said to fall there between.

Unless otherwise specified or implicit from context, any of the features of the various embodiments described herein can be used in conjunction with features described in connection with any other embodiments disclosed. Thus, features described in connection with the various or specific embodiments are not to be construed as not suitable in connection with other embodiments disclosed herein unless such exclusivity is explicitly stated or implicit from context.

We claim:

1. A device for offsetting neck borne weight comprising:
- a head member, wherein the head member comprises
- a head association structure, and
- a pivot mount; and
- an arm assembly, wherein the arm assembly comprises
- an upper member, wherein the upper member is associated with the pivot mount, and
- a lower member, wherein the lower member is flexible and has an upper end and a lower end and the lower member is associated with the upper member at the upper end of the lower member, wherein the lower member is configured to curve or to curve to a greater degree in response to stress and wherein the lower member is connected to the upper member through an intra-arm assembly connector and when the lower member is in a stressed state, the lower member exerts an upward force and a moment on the intra-arm assembly connector, wherein the upward force is in a direction opposite to gravity.

2. The device of claim 1, wherein the upper member is associated with the pivot mount through a connection element that allows one degree of rotational freedom about the yaw axis.

3. The device of claim 1, wherein the upper member is associated with the pivot mount through a connection element that allows a first degree of rotational freedom about a yaw axis, and a second degree of rotational freedom about a roll axis.

4. The device of claim 1, wherein the lower end of the lower member is configured to be associated with a user's torso.

5. A device for offsetting weight of head borne equipment comprising:
- a helmet, wherein the helmet comprises a helmet pivot mount; and
- an arm assembly, wherein the arm assembly comprises
- an upper member, wherein the upper member is associated with the helmet at the helmet pivot mount,
- a left lower arm, wherein the left lower arm has an upper end and a lower end and the left lower arm is associated with the upper member at the upper end of the left lower arm,
- a right lower arm, wherein the right lower arm has an upper end and a lower end and the right lower arm is associated with the upper member at the upper end of the right lower arm,
- a left shoulder connector, wherein the left shoulder connector is located at the lower end of the left lower arm, and
- a right shoulder connector, wherein the right shoulder connector is located at the lower end of the right lower arm,
- wherein the right lower arm and the left lower arm are configured to provide an upward spring force and a moment that offsets the weight of the helmet, wherein the left lower arm and the right lower arm are connected to the upper member through an intra-arm assembly connector and when the right lower arm and the left lower arm are in a stressed state, the right lower arm and the left lower arm exert an upward force and a moment on the intra-arm assembly connector, wherein the upward force is in a direction opposite to gravity.

6. The device of claim 5 wherein the arm assembly further comprises a bearing assembly and the left lower arm and the right lower arm are associated with the upper member at the bearing assembly.

7. The device of claim 5, wherein the upper member has an arc center and the arc center remains in the same vertical plane when the helmet is tilted upward.

8. The device of claim 6, wherein the upper member is in the form of a curved linear guide track.

9. The device of claim 6, wherein the bearing assembly comprises a bearing follower.

10. The device of claim 5, wherein the device further comprises two thrust bearings that permit the arm assembly to pivot at the helmet pivot mount.

11. The device of claim 5, wherein the helmet further comprises an attachment element for an auxiliary device, wherein the attachment element for the auxiliary device is located in the front half of the helmet.

12. The device of claim 11, wherein the attachment element for the auxiliary device is configured to associate the helmet with goggles.

13. The device of claim 12 further comprising night vision goggles, wherein the night vision goggles are associated with the helmet at the attachment element for the auxiliary device.

14. A device for offsetting weight of head borne equipment comprising:

a helmet, wherein the helmet comprises a helmet pivot mount;

an arm assembly, wherein the arm assembly comprises a left arm, wherein the left arm has an upper end and a lower end and the left arm is associated with the helmet at the helmet pivot mount, and a right arm, wherein the right arm has an upper end and a lower end and the right arm is associated with the helmet at the helmet pivot mount;

a left shoulder connector, wherein the left shoulder connector is located at the lower end of the left arm; and a right shoulder connector, wherein the right shoulder connector is located at the lower end of the right arm, wherein the arm assembly provides an upward spring force and a moment that offsets the weight of the helmet, and wherein the left arm and the right arm are connected to an intra-arm assembly connector and when the left arm and the right arm are in a stressed state, the left arm and the right arm exert an upward force and a moment on the intra-arm assembly connector, wherein the upward force is in a direction opposite to gravity.

15. The device of claim 14, wherein the helmet pivot mount is located at about the top center of the helmet.

16. The device of claim 14, wherein the right arm and the left arm each comprise a flexible material.

17. The device of claim 16, wherein the left arm and the right arm form a continuous piece of a flexible material.

18. The device of claim 14, wherein left pivot is in the form of a u-joint and the right pivot is in the form of a u-joint.

19. The device of claim 14, wherein the helmet pivot mount comprises a ball joint.

* * * * *